US008871412B2

(12) United States Patent
Tanaka et al.

(10) Patent No.: US 8,871,412 B2
(45) Date of Patent: Oct. 28, 2014

(54) ELECTROPHOTOGRAPHIC PHOTOCONDUCTOR, IMAGE FORMING METHOD, IMAGE FORMING APPARATUS, AND PROCESS CARTRIDGE

(75) Inventors: Yuuji Tanaka, Shizuoka (JP); Norio Nagayama, Shizuoka (JP); Kazukiyo Nagai, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 44 days.

(21) Appl. No.: 13/823,439

(22) PCT Filed: Sep. 13, 2011

(86) PCT No.: PCT/JP2011/071290

§ 371 (c)(1), (2), (4) Date: Mar. 14, 2013

(87) PCT Pub. No.: WO2012/036295

PCT Pub. Date: Mar. 22, 2012

(65) Prior Publication Data

US 2013/0177842 A1 Jul. 11, 2013

(30) Foreign Application Priority Data

Sep. 15, 2010 (JP) ..... 2010-206681

(51) Int. Cl.

| | |
|---|---|
| ***G03G 5/00*** | (2006.01) |
| ***G03G 5/147*** | (2006.01) |
| ***G03G 5/06*** | (2006.01) |
| ***G03G 5/05*** | (2006.01) |
| ***G03G 5/07*** | (2006.01) |
| ***G03G 5/047*** | (2006.01) |

(52) U.S. Cl.

CPC ..... *G03G 5/047* (2013.01); *G03G 5/14791* (2013.01); *G03G 5/0614* (2013.01); *G03G 5/0592* (2013.01); *G03G 5/14786* (2013.01); *G03G 5/071* (2013.01); *G03G 5/075* (2013.01); *G03G 5/14795* (2013.01); *G03G 5/0557* (2013.01); *G03G 5/076* (2013.01); *G03G 5/14747* (2013.01)

USPC ..... 430/58.75; 399/159

(58) Field of Classification Search

CPC ..... G03G 5/0614

USPC ..... 430/58.75; 399/159

See application file for complete search history.

(56) References Cited

U.S. PATENT DOCUMENTS

| | | | |
|---|---|---|---|
| 4,818,650 | A | 4/1989 | Limburg et al. |
| 5,411,827 | A | 5/1995 | Tamura et al. |

(Continued)

FOREIGN PATENT DOCUMENTS

| | | |
|---|---|---|
| JP | 56-048637 | 5/1981 |
| JP | 64-001728 | 1/1989 |

(Continued)

OTHER PUBLICATIONS

International Search Report Issued Dec. 20, 2011 in PCT/JP11/71290 Filed Sep. 13, 2011.

*Primary Examiner* — Mark A Chapman

(74) *Attorney, Agent, or Firm* — Oblon, Spivak, McClelland, Maier & Neustadt, L.L.P.

(57) ABSTRACT

To provide an electrophotographic photoconductor, which contains a layer containing a cured product obtained by crosslinking (i) a compound containing a charge-transporting group and three or more methylol groups, and (ii) a compound containing a charge-transporting group, which is other than the compound containing a charge-transporting group and three or more methylol groups.

20 Claims, 10 Drawing Sheets

(56) References Cited

U.S. PATENT DOCUMENTS

| | | | |
|---|---|---|---|
| 5,840,816 | A | 11/1998 | Kobayashi et al. |
| 6,406,825 | B1 | 6/2002 | Sakimura et al. |
| 2007/0254224 | A1 | 11/2007 | Sugino |
| 2008/0299472 | A1 | 12/2008 | DeJong et al. |
| 2011/0200926 | A1 | 8/2011 | Tanaka et al. |

FOREIGN PATENT DOCUMENTS

| | | |
|---|---|---|
| JP | 04-281461 | 10/1992 |
| JP | 06-118681 | 4/1994 |
| JP | 09-124943 | 5/1997 |
| JP | 09-190004 | 7/1997 |
| JP | 2000-066425 | 3/2000 |
| JP | 2000-171990 | 6/2000 |
| JP | 2001-100447 | 4/2001 |
| JP | 3194392 | 6/2001 |
| JP | 2001-188377 | 7/2001 |
| JP | 3262488 | 12/2001 |
| JP | 2003-186223 | 7/2003 |
| JP | 2007-293197 | 11/2007 |
| JP | 2008-299327 | 12/2008 |
| JP | 4262061 | 2/2009 |
| JP | 2011-191744 | 9/2011 |

ELECTROPHOTOGRAPHIC PHOTOCONDUCTOR, IMAGE FORMING METHOD, IMAGE FORMING APPARATUS, AND PROCESS CARTRIDGE

TECHNICAL FIELD

The present invention relates to an electrophotographic photoconductor (which may be also referred to as a "photoconductor" hereinafter), as well as an image forming method, image forming apparatus and process cartridge each using the electrophotographic photoconductor.

BACKGROUND ART

Recently, organic photoconductors photoconductor (OPC) have been widely used in photocopiers, facsimiles, laser printers, and compound machines thereof instead of inorganic photoconductors, because the organic photoconductors have excellent properties, and various advantages. Examples of the reasons of the favorable use of the organic photoconductors include (1) optical properties such as a wide wavelength range of light absorption, (2) electric properties such as high sensitivity, and stable charging properties, (3) wide selections of materials for use, (4) easiness of the production, (5) low cost, and (6) nontoxic.

Moreover, diameters of photoconductors have been recently reduced for downsizing image forming apparatuses, and high durability of photoconductors has been strongly desired because of the trends for high-speed of devices, and maintenance free. From this point of view, organic photoconductors have drawbacks that it is generally soft as a charge-transporting layer contains a low molecular charge-transporting material and an inert polymer as main components, and it is easily abraded by mechanical loads from a developing system or cleaning system after repetitive use in an electrophotographic process.

In addition, diameters of toner particles have been reduced to respond to the demands for high image quality. To improve cleaning ability accompanied with the toner of the reduced particle diameter, rubber hardness of a cleaning blade and contact pressure need to be increased for improving cleaning ability. This is another factor for accelerating abrasion of a photoconductor. Such abrasion of the photoconductor lowers the electric properties, such as deterioration of the sensitivity, and lowering the charging ability, which is a cause of image defects such as low image density and background depositions.

Moreover, the scratch formed by being locally abraded forms line-shaped smears in an image due to cleaning failures.

Accordingly, various attempts have been mend to improve abrasion resistance of organic photoconductors. Examples thereof include: a technology using a curable binder in a charge-transporting layer (see PTL 1); a technology using a high molecular charge-transporting material (see PTL 2); a technology where inorganic filler is dispersed in a charge-transporting layer (see PTL 3); a technology where a cured product of polyfunctional acrylate monomers is contained (see PTL 4); a technology of providing a charge-transporting layer formed with a coating liquid containing a monomer having carbon double bonds, a charge-transporting material having carbon double bonds, and a binder resin (see PTL 5); a technology where a compound obtained by curing a hole-transporting compound having two or more chain-polymerizable functional groups per molecule is contained (see PTL 6); a technology using a colloidal silica-contained cured silicone resin (see PTL 7); a technology of providing a resin layer formed by binding an organic silicon-modified hole-transporting compound into a curable organic silicon-based polymer (see PTLs 8 and 9); a technology where a curing siloxane resin having a charge-transporting properties donating group are cured in the three-dimensional network structure (see PTL 10); a technology where a resin that is three-dimensionally crosslinked with a charge-transporting material having at least one hydroxyl group, and conductive particles are contained (see PTL 11); a technology where a crosslinked resin formed by crosslinking a reactive charge-transporting material with polyol containing at least two hydroxyl groups, and an aromatic isocyanate compound is contained (see PTL 12); a technology where a melamine formaldehyde resin three-dimensionally crosslinked with a charge-transporting material having at least one hydroxyl group is contained (see PTL 13); and a technology where a resol-type phenol resin three-dimensionally crosslinked with a charge-transporting material having a hydroxyl group is contained (see PTL 14).

CITATION LIST

Patent Literature

PTL 1 Japanese Patent Application Laid-Open (JP-A) No. 56-48637
PTL 2 JP-A No. 64-1728
PTL 3 JP-A No. 04-281461
PTL 4 Japanese Patent (JP-B) No. 3262488
PTL 5 JP-B No. 3194392
PTL 6 JP-A No. 2000-66425
PTL 7 JP-A No. 06-118681
PTL 8 JP-A No. 09-124943
PTL 9 JP-A No. 09-190004
PTL 10 JP-A No. 2000-171990
PTL 11 JP-A No. 2003-186223
PTL 12 JP-A No. 2007-293197
PTL 13 JP-A No. 2008-299327
PTL 14 JP-B No. 4262061

SUMMARY OF INVENTION

Technical Problem

The present invention has been made by reflecting the situation as mentioned, and the present invention aims to solve the various problems in the art, and achieve the following object. An object of the present invention is provide an electrophotographic photoconductor, which has high abrasion resistance in repetitive use, maintains high image quality with fewer image defects for a long period of time, hardly causes image defects in the form of white spots, has high surface smoothness at the initial stage and after time lapse, and has high durability, as well as providing an image forming method, image forming apparatus, and process cartridge each using the electrophotographic photoconductor.

Solution to Problem

The means for solving the problems mentioned above are as follows:

<1> An electrophotographic photoconductor, containing:

a layer containing a cured product obtained by crosslinking (i) a compound containing a charge-transporting group and three or more methylol groups, and (ii) a compound containing a charge-transporting group, which is other than the compound containing a charge-transporting group and three or more methylol groups.

<2> The electrophotographic photoconductor according to <1>, wherein (i) the compound containing a charge-transporting group and three or more methylol groups is N,N,N-trimethyloltriphenyl amine represented by the following structural formula (1):

Structural Formula (1)

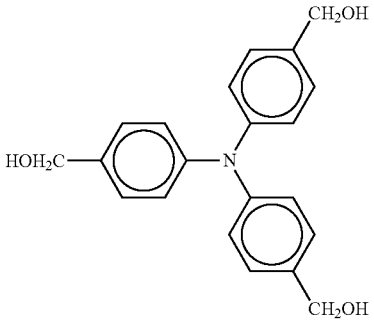

<3> The electrophotographic photoconductor according to <1>, wherein (i) the compound containing a charge-transporting group and three or more methylol groups is a compound represented by the following general formula (1):

General Formula (1)

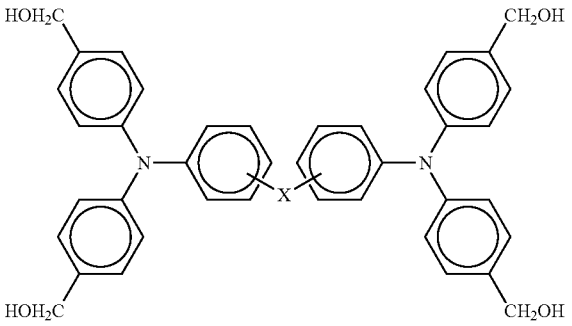

where X is —$CH_2$—, —O—, —CH═CH—, or —$CH_2CH_2$—.

<4> The electrophotographic photoconductor according to any one of <1> to <3>, wherein (ii) the compound containing a charge-transporting group, which is other than the compound containing a charge-transporting group and three or more methylol groups, is triphenyl amine represented by the following general formula (2):

General Formula (2)

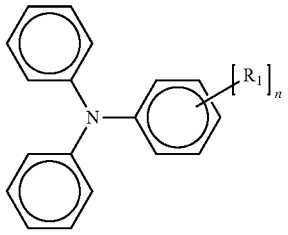

where $R_1$ is a hydrogen atom or a methyl group; and n is 1 to 4, and in the case where n is 2 to 4, $R_1$ may be identical or different.

<5> The electrophotographic photoconductor according to any one of <1> to <3>, wherein (ii) the compound containing a charge-transporting group, which is other than the compound containing a charge-transporting group and three or more methylol groups, is a compound represented by the following general formula (3):

General Formula (3)

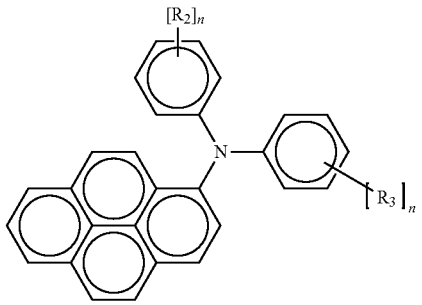

where $R_2$, and $R_3$ may be identical or different, and are each a hydrogen atom or a methyl group; and n is 1 to 4 and in the case where n is 2 to 4, $R_2$ may be identical or different and $R_3$ may be identical or different.

<6> The electrophotographic photoconductor according to any one of <1> to <3>, wherein (ii) the compound containing a charge-transporting group, which is other than the compound containing a charge-transporting group and three or more methylol groups, is a compound represented by the following general formula (4):

General Formula (4)

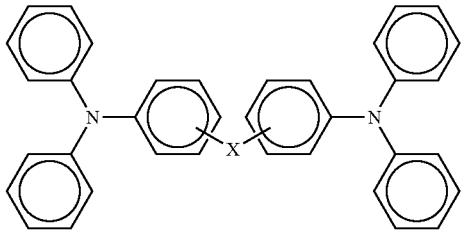

where X is —$CH_2$—, —O—, —CH═CH—, or —$CH_2CH_2$—.

<7> The electrophotographic photoconductor according to any one of <1> to <6>, wherein the layer containing the cured product is an outermost layer.

<8> The electrophotographic photoconductor according to <7>, further containing:

a substrate;

a charge-generating layer provided above the substrate;

a charge-transporting layer provided above the charge-generating layer; and a crosslinked charge-transporting layer provided above the charge-transporting layer, wherein the crosslinked charge-transporting layer is the outermost layer of the electrophotographic photoconductor.

<9> An image forming method, containing:

charging a surface of an electrophotographic photoconductor;

exposing the charged surface of the electrophotographic photoconductor to light to form a latent electrostatic image;

developing the latent electrostatic image with a toner to form a visible image;

transferring the visible image to a recording medium; and fixing the transferred visible image on the recording medium, wherein the electrophotographic photoconductor is the electrophotographic photoconductor as defined in any one of <1> to <8>.

<10> The image forming method according to <9>, wherein the exposing contains writing the latent electrostatic image on the electrophotographic photoconductor with the light in a digital method.

<11> An image forming apparatus, containing:

the electrophotographic photoconductor as defined in any one of <1> to <8>;

a charging unit configured to charge a surface of the electrophotographic photoconductor;

an exposing unit configured to expose the charged surface of the electrophotographic photoconductor to light to form a latent electrostatic image;

a developing unit configured to develop the latent electrostatic image with a toner to form a visible image;

a transferring unit configured to transfer the visible image to a recording medium; and a fixing unit configured to fix the transferred visible image on the recording medium.

<12> The image forming apparatus according to <11>, wherein the exposing unit is configured to write the latent electrostatic image on the electrophotographic photoconductor with the light in a digital method.

<13> A process cartridge, containing:

the electrophotographic photoconductor as defined in any one of <1> to <8>; and at least one selected from the group consisting of:

a charging unit, an exposing unit, a developing unit, a transferring unit, a cleaning unit, and a diselectrification unit, wherein the process cartridge is detachably mounted in a main body of an image forming apparatus.

Advantageous Effects of Invention

The present invention can solve various problems in the art, and can provide an electrophotographic photoconductor, which has high abrasion resistance in repetitive use, maintains high image quality with fewer image defects for a long period of time, hardly causes image defects in the form of white spots, has high surface smoothness at the initial stage and after time lapse, and has high durability, as well as providing an image forming method, image forming apparatus, and process cartridge each using the electrophotographic photoconductor.

DESCRIPTION OF EMBODIMENTS

Figure 1:
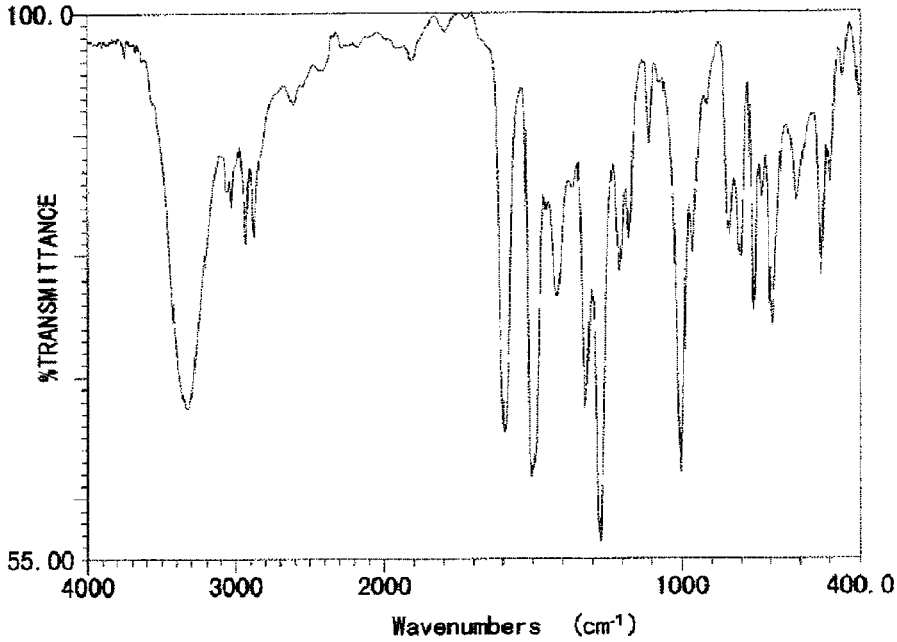
FIG. 1 is an IR absorption spectrum diagram (the KBr pellet technique) of the compound obtained in Synthesis Example 1, and the transverse axis indicate the wave number ($cm^{-1}$), and the ordinate axis indicates the transmittance (%).

The electrophotographic photoconductor of the present invention, and an electrophotographic method (an image forming method), an electrophotographic apparatus (an image forming apparatus), and an electrophotographic process cartridge (a process cartridge) each using the electrophotographic photoconductor will be specifically explained hereinafter.

The electrophotographic photoconductor of the present invention contains a layer containing a cured product obtained by crosslinking a compound containing a charge-transporting group and three or more methylol groups (which may be also referred to as "Compound A" hereinafter), and a compound containing a charge-transporting group (which may be also referred to as "Compound B" hereinafter), which is other than the compound containing a charge-transporting group and three or more methylol groups.

The electrophotographic photoconductor of the present invention can prevent external additives of high hardness contained in a toner, such as silica particles, from sticking into the photoconductor, to thereby reduce image defects in the form of white spots, while maintaining excellent abrasion resistance and electric properties. The reason for this is considered as follows.

A surface layer of a conventional photoconductor is formed of a thermoplastic resin in which a low molecular charge-transporting agent is dispersed, which is softer than inorganic filler such as silica. Therefore, the inorganic filler is easily stuck therein when the surface layer and the inorganic filler are in contact. Therefore, it is important to increase the surface hardness. To this end, the material of the surface layer is changed to a high molecular charge-transporting resin without dispersing the low molecular charge-transporting agent therein, but the modified surface layer in this manner has not have any improvement. Therefore, a crosslinked resin whose crosslinking density has been enhanced is desirably used for the surface layer, and a crosslinked layer using a polyfunctional monomer is advantageous as the surface layer.

To provide the electrophotographic photoconductor with excellent electric properties, it is desirable to incorporate a charge-transporting substance in the crosslinked film. Various methods have been proposed in the past to achieve such the crosslinked film. In the case where curing is performed by adding a charge-transporting material to alkoxysilanes, for example, the compatibility between the charge-transporting material and the siloxane component is often poor. This compatibility can be improved by using a charge-transporting material having a hydroxyl group. However, a large amount of the hydroxyl groups are remained, which may cause image blurring in the high humidity environment. Therefore, a system such as a drum heater is required. Moreover, in the case where curing is performed by adding a charge-transporting material having a hydroxyl group to a resin having a high polar unit, such as a urethane resin, the charge mobility of the charge-transporting material reduces as the dielectric constant is low, and the residual potential increases, which fails to provide satisfactory image quality.

In the case where curing is performed by adding a charge-transporting material having a hydroxyl group to a phenol resin, the phenolic hydroxyl group adversely affects the electric properties, which tends to degrade. The degradation of the electric properties is prevented by controlling the amount of the phenolic hydroxyl groups, or replacing the phenolic hydroxyl groups with certain groups.

As mentioned above, it is conventionally difficult to satisfy all the properties desired, and the present invention realizes excellent charge-transporting properties by performing curing with highly reactive methylol group, without adversely affecting electric properties of the resulting electrophotographic photoconductor. For further accelerating a progress of a crosslink reaction in a heating process, a curing catalyst such as a curing accelerator, and polymerization initiator, may be added.

The specific mechanism of the crosslink reaction is not clear, but triphenyl amine compound having methylol groups can proceed to a crosslink reaction with a trace of a curing catalyst (1% by mass or less, for example, 0.5% by mass or less in the case of a strongly acidic catalyst such as p-toluenesulfonic acid). It has been found that the condensation reaction between the methylol groups form ether bonds, or the further progressed condensation reaction forms methylene bonds, or a condensation reaction of the methylol groups with benzene rings of triphenyl amine structure or hydrogen atoms of condensed polycyclic aromatic rings forms methylene bonds. A three-dimensionally cured film having extremely high crosslinking density can be formed by these condensation reactions between molecules.

As mentioned above, a film having extremely high crosslinking density can be formed while maintaining excellent electric properties, and because of this film, various desirable properties of a photoconductor are attained, and sticking of silica particles or the like into the photoconductor can be presented, and image defects in the form of white spots can be reduced. In this case, the gel fraction of the cured product is preferably 95% or higher, more preferably 97% or higher. With use of the cured product as mentioned, the abrasion resistance is further improved, and an electrophotographic photoconductor giving fewer image defects and having a long service life can be provided.

Accordingly, by using the electrophotographic photoconductor of the present invention having the configuration mentioned above, an image forming method, an image forming apparatus, and a process cartridge each of which achieves high image quality for a long period of time can be provided.

In the present invention, the mass ratio (Compound B/Compound A) of Compound B (aryl compound) to Compound A (methylol compound) is preferably 1/99 to 70/30, more preferably 20/80 to 60/40.

When the amount of Compound B is smaller than 1/99 in the mass ratio (i.e., the amount of Compound A is larger than 99/1 in the mass ratio), the amounts of these compounds do not contribute to further increase of the gel fraction, but there are cases where the electric static properties of the resulting photoconductor may be impaired. When the amount of Compound B is smaller than 70/30 in the mass ratio (i.e. the amount of the Compound A is larger than 30/70 in the mass ratio), the gel fraction may not be sufficiently obtained.

(Electrophotographic Photoconductor)

The electrophotographic photoconductor of the present invention contains a layer containing a cured product obtained by crosslinking (i) a compound containing a charge-transporting group and three or more methylol groups, and (ii) a compound containing a charge-transporting group, which is other than (i) the compound containing a charge-transporting group and three or more methylol groups, and may further contain other layers, if necessary.

[Layer Containing Cured Product]

The layer containing the cured product is a layer containing the cured product obtained by crosslinking (i) the compound containing a charge-transporting group and three or more methylol groups, and (ii) the compound containing a charge-transporting group, which is other than (i) the compound containing a charge-transporting group and three or more methylol groups.

<Compound Containing Charge-Transporting Group and Three or More Methylol Groups (Compound A)>

The compound containing a charge-transporting group and three or more methylol groups is appropriately selected depending on the intended purpose without any restriction, but it is preferably N,N,N-trimethyloltriphenyl amine represented by the following structural formula (1), or a compound represented by the following general formula (1).

Structural Formula (1)

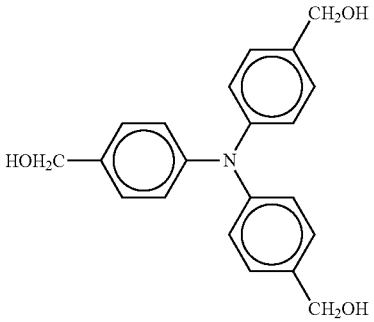

-continued

General Formula (1)

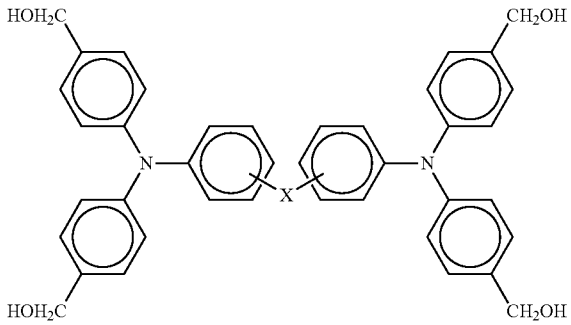

In the general formula (1), X is —$CH_2$—, —O—, —CH═CH—, or —$CH_2CH_2$—.

The methylol compound represented by the structural formula (1) is determined as Compound No. 1, but as mentioned above, other examples of Compound A preferably include the methylol compound represented by the general formula (1).

Compound No. 1

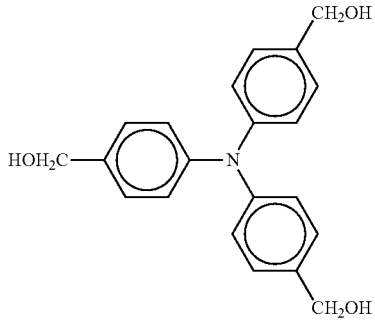

Specific examples of Compound A (methylol compound) will be listed below, but the compound for use in the present invention is not limited to these compounds listed below.

TABLE 1

| Compound No. of Compound A | |
|---|---|
| Compound No. 1 | 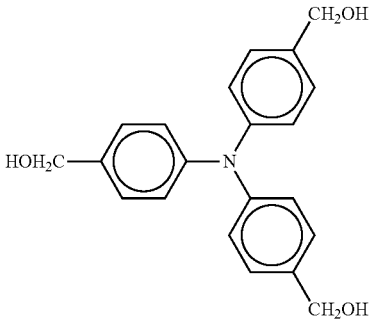 |

Methylol compound of Structural Formula (1)

TABLE 1-continued

| Compound No. of Compound A | | |
|---|---|---|
| Compound No. 2 | General Formula (1) | Site |
| | 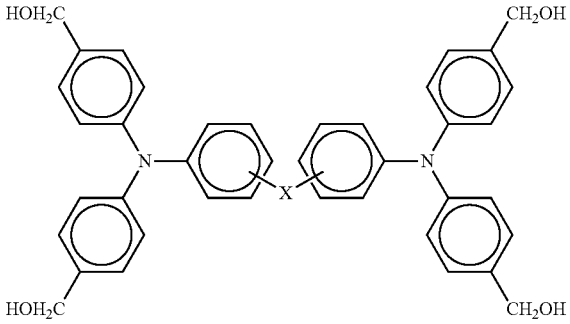 | 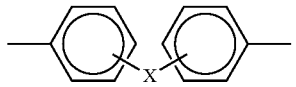 of General Formula (1) |
| Compound No. 3 | | 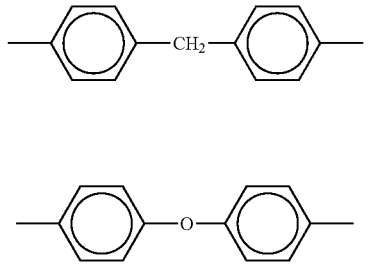 |
| Compound No. 4 | | 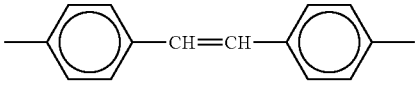 |
| Compound No. 5 | | 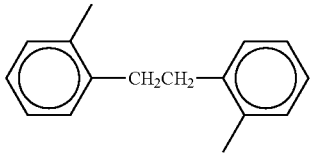 |

<Production of Compound A (Methylol Compound)>

The methylol compound represented by the structural formula (1) or general formula (1) can be easily synthesized in the following production method, for example by synthesizing an aldehyde compound in the manner mentioned below, and reacting the obtained aldehyde compound and a reducing agent such as sodium borohydride.

—Synthesis of Aldehyde Compound—

As shown in the following reaction formula, the aldehyde compound can be synthesized by formylation carried out by the method known in the art (e.g. Vilsmeier-Haack reaction) using a triphenyl amine compound as a starting material. Specific examples of the method include formylation disclosed in Japanese Patent (JP-B) No. 3943522.

-continued

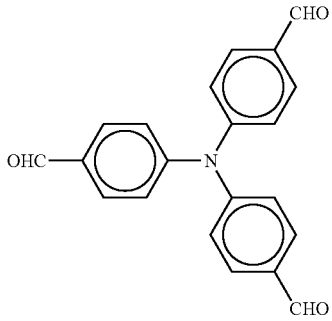

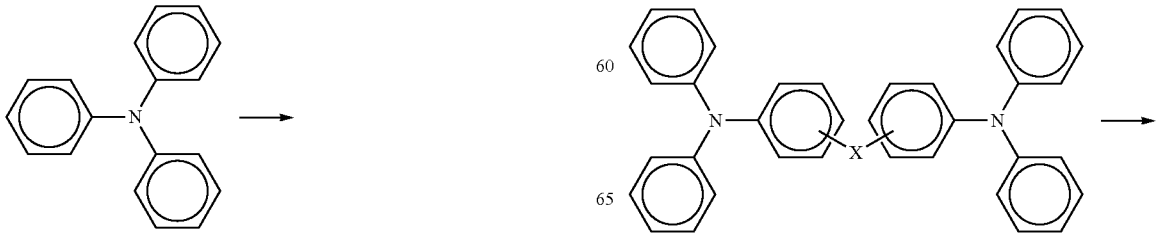

-continued

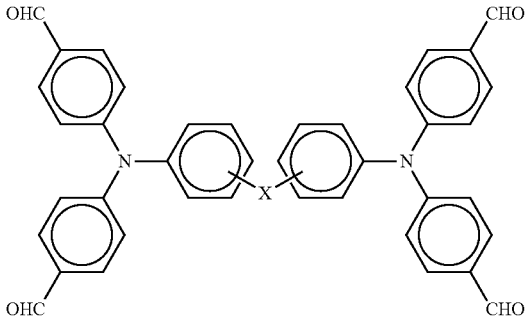

As the specific method for formylation, a method using zinc chloride/phosphorous oxychloride/dimethylformaldehyde is effective, but a synthesis method for obtaining the aldehyde compound that is the intermediate of Compound A is not limited the methods mentioned above. Specific synthesis examples will be described in Examples.

—Synthesis of Compound A (Methylol Compound)—

Compound A can be synthesized by a reduction method known in the art using the aldehyde compound as the production intermediate, as shown in the following reaction formula.

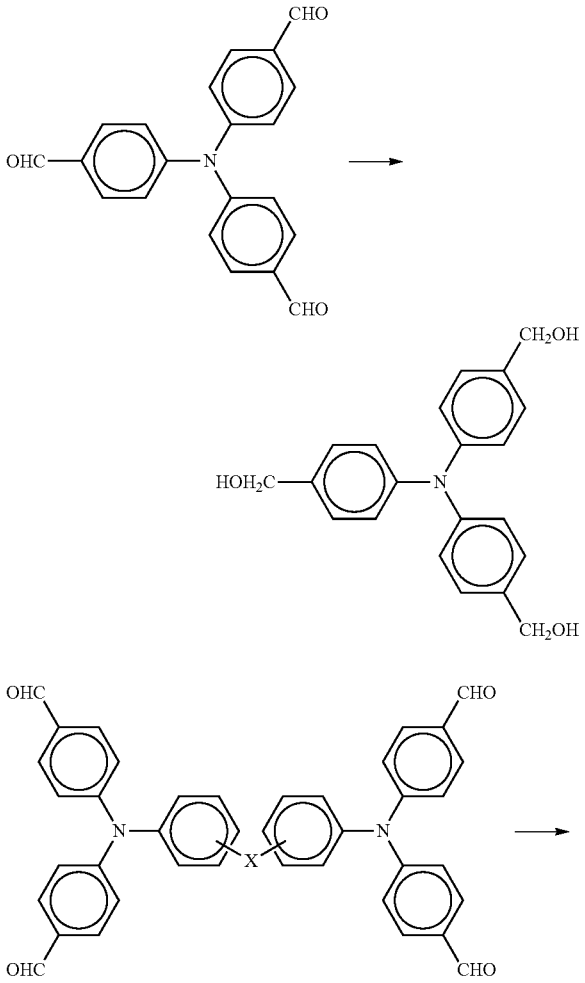

-continued

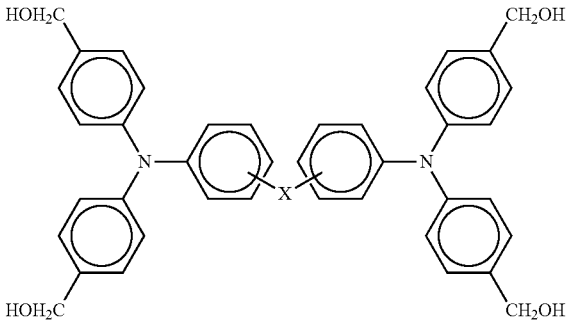

As the specific reduction, a method using sodium borohydride is effective, but a synthesis method for obtaining Compound A (the methylol compound) is not limited the method mentioned above. Specific synthesis examples will be described in Examples.

<Compound Containing Charge-Transporting Group (Compound B) Other than Compound Containing Charge-Transporting Group and Three or More Methylol Groups>

Compound B for use in the present invention will be specifically explained next.

The compound containing a charge-transporting group (Compound B) other than the compound containing a charge-transporting group and three or more methylol groups is appropriately selected depending on the intended purpose without any restriction, and is preferably any of the compounds represented by the following general formulae (2) to (4).

General Formula (2)

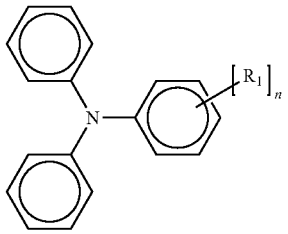

In the general formula (2), $R_1$ is a hydrogen atom or a methyl group, and n is 1 to 4; and in the case where n is 2 to 4, $R_1$ may be identical or different.

General Formula (3)

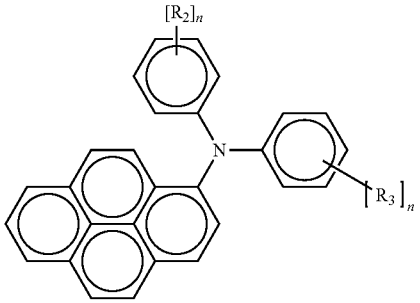

In the general formula (3), $R_2$ and $R_3$ may be identical or different, and are each a hydrogen atom or a methyl group; and n is an integer of 1 to 4 and in the case where n is 2 to 4, $R_2$ may be identical or different and $R_3$ may be identical or different.

General Formula (4)

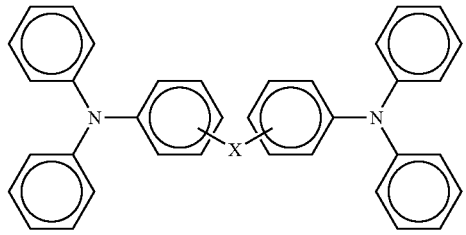

In the general formula (4), X is —$CH_2$—, —O—, —CH═CH—, or —$CH_2CH_2$—.

Specific examples of Compound B will be listed below, but are not limited to the compounds listed.

TABLE 2

| Compound No. of Compound B | | |
|---|---|---|
| Compound No. 6 | 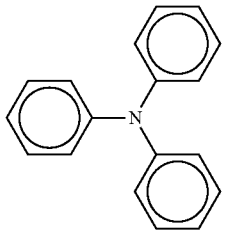 Aryl compound of General Formula (2) | |
| Compound No. 7 | General Formula (3) 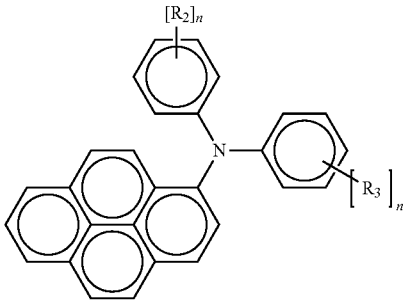 | Site 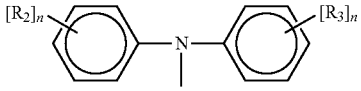 n = 1 of General Formula (3) 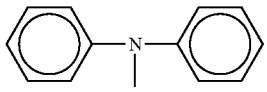 |
| Compound No. 8 | | 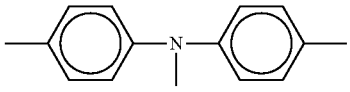 |
| Compound No. 9 | | 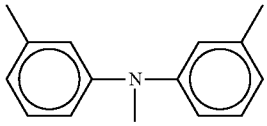 |
| Compound No. 10 | | 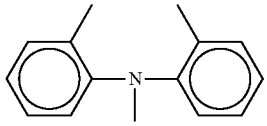 |

TABLE 2-continued

| Compound No. of Compound B | | |
|---|---|---|
| Compound No. 11 | General Formula (4) | Site |
| | 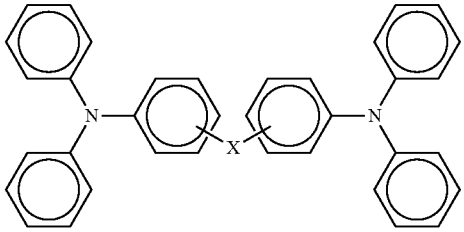 | 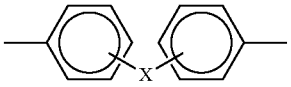 of General Formula (4) |
| Compound No. 12 | | 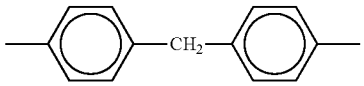 |
| Compound No. 13 | | 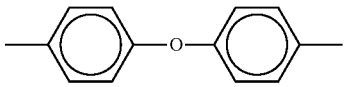 |
| Compound No. 14 | | 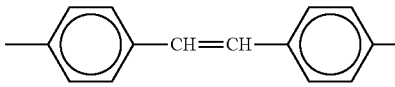 |

<Formation of Cured Product>

In the present invention, a film having excellent charge-transporting properties and high crosslinking density can be formed by the cure occurred owing to methylol groups, which do not adversely affect electric properties and has high reactivity, and N-substituted benzene rings, or condensed polycyclic aromatic rings. As a result, the demands for mechanical durability such as abrasion resistance, and heat resistance can be achieved, as well as achieving excellent charge-transporting properties at the same time.

The method for forming the layer containing the cured product will be explained.

The layer containing the cured product can be formed, for example, by preparing a coating liquid containing Compound A and Compound B, applying the coating liquid to a surface of the photoconductor, and heating for drying to thereby polymerize the coating liquid.

In the case where the polymerizable monomer is in the form of a fluid, it is possible to apply the coating liquid after dissolving other substances in the coating liquid. If necessary, the coating liquid is diluted with a solvent, and then applied.

Examples of the solvent include: an alcohol solvent such as methanol, ethanol, propanol, and butanol; a ketone solvent such as acetone, methylethyl ketone, methylisobutyl ketone, and cyclohexanone; an ester solvent such as ethyl acetate, and butyl acetate; an ether solvent such as tetrahydrofuran, dioxane, and propyl ether; a halogen solvent such as dichloromethane, dichloroethane, trichloroethane, and chlorobenzene; an aromatic solvent such as benzene, toluene, and xylene; and Cellosolve (registered trademark) solvent such as methyl cellosolve, ethyl cellosolve, and cellosolve acetate. These solvents may be used independently, or two or more of these solvents may be used as a mixture. The dilution ratio by the solvent varies depending on the solubility of the composition, coating method, and intended thickness to be formed, and therefore it can be optimized.

The coating can be performed by dip coating, spray coating, bead coating, ring coating, or the like.

Moreover, the coating liquid optionally contains additives such as various plasticizers (for the purpose of stress relaxation or improving adhesion), a leveling agent, and a non-reactive low molecular charge-transporting material. As these additives, conventional additives known in the art can be used. As the leveling agent, silicone oils (e.g. dimethyl silicone oil, and methylphenyl silicone oil), or polymers or oligomers having a perfluoroalkyl group in the side chain thereof can be used. An amount of the additives for use is preferably 3% by mass or less relative to the total solid contents of the coating liquid.

After applying the coating liquid, curing is performed in the heat drying process. To achieve the object of the present invention, the gel fraction of the cured product is preferably 95% or higher, more preferably 97% or higher. Sticking of silica or the like on the surface of the photoconductor can be prevented by increasing the gel fraction.

Here, the gel fraction can be obtained by dipping the cured product in an organic solvent having high solubility such as tetrahydrofuran for 5 days, measuring loss in the mass, and calculating based on the following mathematical formula (1):

$$\text{Gel fraction}(\%)=100\times(\text{mass of cured product after dipping and drying}/\text{initial mass of cured product}) \quad \text{Mathematical Formula (1)}$$

The layer structure of the electrophotographic photoconductor of the present invention is not particularly limited, but it is preferred that the layer containing the cured product be an outermost layer. Since the properties of the compounds represented by the structural formula (1), and general formulae (1) to (4) are hole-transporting properties, it is preferably formed on a surface of an organic photoconductor of a negative charging system.

A typical structure of the organic photoconductor of the negative charging system is a structure in which at least an undercoat layer, a charge-generating layer, a charge-transporting layer are laminated on a substrate, and the cured product can be contained in the charge-transporting layer. In this case, however, the thickness of the charge-transporting layer is restricted by the curing conditions. Therefore, a structure of the photoconductor where a crosslinked charge-transporting layer is further laminated on the charge-transporting layer is preferable, and a structure thereof where the crosslinked charge-transporting layer is the layer containing the cured product is more preferable.

The electrophotographic photoconductor contains the substrate, and at least the charge-generating layer, the charge-transporting layer, and the crosslinked charge-transporting layer laminated in this order on the substrate, and preferably further contain an intermediate layer, and other layers, if necessary. Here, the crosslinked charge-transporting layer that is an outermost layer is the layer containing the cured product.

<Charge-Generating Layer>

The charge-generating layer contains at least a charge-generating material, and may further contain a binder resin, and other substances, if necessary.

As the charge-generating material, an inorganic material and an organic material can be used.

Examples of the inorganic material include crystal celenium, amorphous selenium, selenium-tellurium, selenium-tellurium-halogen, a selenium-arsenic compound, amorphous silicone. As for the amorphous silicone, the one dangling bonds of which are terminated with a hydrogen atom, or halogen atom, the one dangling bonds of which are doped with a boron atom, a phosphorous atom, or the like are suitable.

The organic material is appropriately selected from those known in the art depending on the intended purpose without any restriction. Examples of the organic material include: phthalocyanine-based pigments (e.g. metal phthalocyanine, and non-metallic phthalocyanine), azulenium salt pigments, quadratic acid methine pigments, azo pigments having a carbazole skeleton, azo pigments having a triphenyl amine skeleton, azo pigments having a diphenyl amine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyryl carbazole skeleton, perylene-based pigments, anthraquinone-based or polycyclic quinone-based pigments, quinone imine-based pigments, diphenylmethane-based or triphenylmethane-based pigments, benzoquinone-based or naphthoquinone-based pigments, cyanine-based or azomethine-based pigments, indigoid-based pigments, and bisbenzimidazole-based pigments. These may be used independently, or in combination.

The binder resin is appropriately selected depending on the intended purpose without any restriction, and examples thereof include a polyamide resin, a polyurethane resin, an epoxy resin, a polyketone resin, a polycarbonate resin, a silicone resin, an acrylic resin, a polyvinyl butyral resin, a polyvinyl formal resin, a polyvinyl ketone resin, a polystyrene resin, a poly-N-vinyl carbazole resin, and a polyacryl amide resin. These may be used independently, or in combination.

Moreover, as the binder resin for use in the charge-generating layer, other than the binder resin mentioned above, charge transporting high polymeric materials can be used, and examples thereof include:

(1) a high polymeric material having a aryl amine skeleton, benzidine skeleton, hydrazone skeleton, carbazole skeleton, stilbene skeleton, pyrazoline skeleton, or the like, such as polycarbonate, polyester, polyurethane, polyether, polysiloxane, and an acrylic resin; and (2) a high polymeric material having a polysilane skeltone.

Specific examples of the high polymeric material of (1) include charge transporting high polymeric materials disclosed in JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, and 09-328539.

Specific examples of the high polymeric material of (2) include polysilylene polymers and the like disclosed in JP-A Nos. 63-285552, 05-19497, 05-70595, and 10-73944.

Moreover, the charge-generating layer may contain a low molecular charge-transporting material.

The low molecular charge-transporting material includes a hole transporting material, and an electron transporting material.

Examples of the electron transporting material include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, 1,3,7-trinitrodibenzothiophene-5,5-dioxide, and diphenoquinone derivatives. These may be used independently, or in combination.

Examples of the hole transporting material include oxazole derivatives, oxadiazole derivatives, imidazole derivatives, monoaryl amine derivatives, diaryl amine derivatives, triaryl amine derivatives, stilbene derivatives, α-phenylstilbene derivatives, benzidine derivatives, diaryl methane derivatives, triaryl methane derivatives, 9-styryl anthracene derivatives, pyrazoline derivatives, divinylbenzene derivatives, hydrazone derivatives, indene derivatives, butadiene derivatives, pyrene derivatives, bisstilbene derivatives, enamine derivatives, and other comventional materials known in the art. These may be used independently, or in combination.

Examples of the formation method of the charge-generating layer include a vacuum thin film forming method, and a casting method using a dispersion solution.

For the vacuum thin film forming method, for example, vacuum deposition, glow discharge decomposition, ion plating, sputtering, reactive sputtering, CVD, or the like is used.

For the casting method, the inorganic or organic charge-generating material is dispersed, optionally with a binder resin, using a solvent (e.g., tetrahydrofuran, dioxane, dioxolane, toluene, dichloromethane, monochlorobenzene, dichloroethane, cyclohexanone, cyclopentanone, anisole, xylene, methylethylketone, acetone, ethyl acetate, and butyl acetate) by means of a ball mill, attritor, sand mill, bead mill, or the like, the prepared dispersion liquid is diluted to an appropriate degree, and is coated to form the charge-generating layer. If necessary, a leveling agent such as dimethyl silicone oil, and methylphenyl silicone oil is further added. The coating can be performed by dip coating, spray coating, bead coating, ring coating, or the like.

The thickness of the charge-generating layer is appropriately selected depending on the intended purpose without any restriction, but it is preferably 0.01 μm to 5 μm, more preferably 0.05 μm to 2 μm.

<Charge-Transporting Layer>

The charge-transporting layer is a layer intended to hold electrification charge, and to transfer the charge generated in and separated from the charge-generating layer by exposure to bind the electrification charge held therein with the transferred charge. To hold the electrification charge therein, the charge-transporting layer is desired to have high electric resistance. To obtain high surface potential with the electrification charge held therein, the charge-transporting layer is desired to have low dielectric constant and excellent charge transferring properties.

The charge-transporting layer contains at least a charge-transporting material, and may further contain a binder resin, and other substances, if necessary.

Examples of the charge-transporting material include a hole transporting material, an electron transporting material, and a high polymeric charge-transporting material.

Examples of the electron transporting material (electron-accepting material) include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. These may be used independently, or in combination.

Examples of the hole transporting material (electron-donating material) include oxazole derivatives, oxadiazole derivatives, imidazole derivatives, triphenyl amine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzoimidazole derivatives, and thiophene derivatives. These may be used independently, or in combination.

The high polymeric charge-transporting material includes those having the structures below:

(a) Examples of the polymer containing a carbazole ring include poly-N-vinyl carbazole, and compounds disclosed in JP-A Nos. 50-82056, 54-9632, 54-11737, 04-175337, 04-183719, and 06-234841.

(b) Examples of the polymer having the hydrazone structure include compounds disclosed in JP-A Nos. 57-78402, 61-20953, 61-296358, 01-134456, 01-179164, 03-180851, 03-180852, 03-50555, 05-310904, and 06-234840.

(c) Examples of the polysilylene polymer include compounds disclosed in JP-A Nos. 63-285552, 01-88461, 04-264130, 04-264131, 04-264132, 04-264133, and 04-289867.

(d) Examples of the polymer having the triaryl amine structure include N,N-bis(4-methylphenyl)-4-aminopolystyrene, and compounds disclosed in JP-A Nos. 01-134457, 02-282264, 02-304456, 04-133065, 04-133066, 05-40350, and 05-202135.

(e) Examples of other polymers include a formaldehyde condensation polymerization product of nitropyrene, and compounds disclosed in JP-A Nos. 51-73888, 56-150749, 06-234836, and 06-234837.

Moreover, in addition to the above, examples of the high polymeric charge-transporting material include a polycarbonate resin having a triaryl amine structure, a polyurethane resin having a triaryl amine structure, a polyester resin having a triaryl amine structure, and a polyether resin having a triaryl amine structure. Examples of the charge transporting high polymeric compound include compounds disclosed in JP-A Nos. 64-1728, 64-13061, 64-19049, 04-11627, 04-225014, 04-230767, 04-320420, 05-232727, 07-56374, 09-127713, 09-222740, 09-265197, 09-211877, and 09-304956.

As the polymer having the electron-donating group, in addition to the polymers listed above, copolymers with conventional monomers, block polymers, graft polymers, and star polymers can be used, and for example, a crosslnked polymer having an electron-donating group as disclosed in JP-A No. 03-109406 can be used.

Examples of the binder resin include a polycarbonate resin, a polyester resin, a methacryl resin, an acrylic resin, a polyethylene resin, a polyvinyl chloride resin, a polyvinyl acetate resin, a polystyrene resin, a phenol resin, an epoxy resin, a polyurethane resin, a polyvinylidene chloride resin, an alkyd resin, a silicone resin, a polyvinyl carbazole resin, a polyvinyl butyral resin, a polyvinyl formal resin, a polyacrylate resin, a polyacryl amide resin, and a phenoxy resin. These may be used independently, or in combination.

Note that, the charge-transporting layer may contain a copolymer of a crosslinkable binder resin and a crosslinkable charge-transporting material.

The charge-transporting layer can be formed by dissolving or dispersing the charge-transporting material and the binder resin in an appropriate solvent to form a coating liquid, applying and drying the coating liquid. In addition to the charge-transporting material, and the binder resin, the charge-transporting layer may further contain additives, such as a plasticizer, an antioxidant, and a leveling agent, in an appropriate amount, if necessary.

The solvent used for coating of the charge-transporting layer may be the same as the solvent used for the charge-generating layer, and is suitably a solvent that can easily dissolve the charge-transporting material and the binder resin. These solvents may be used independently, or in combination. Moreover, for the formation of the charge-transporting layer, the similar coating methods as mentioned earlier can be used.

The plasticizer or leveling agent can be added, if necessary.

Examples of the plasticizer include conventional plasticizers used for general resins, such as dibutyl phthalate, and dioctyl phthalate, and an amount of the plasticizer for use is appropriately about 0 parts by mass to about 30 parts by mass relative to 100 parts by mass of the binder resin.

Examples of the leveling agent include: silicone oils such as dimethyl silicone oil, and methylphenyl silicone oil; and polymers and oligomers each having a perfluoroalkyl group in the side chain thereof. An amount of the leveling agent for use is appropriately about 0 parts by mass to about 1 part by mass relative to 100 parts by mass of the binder resin.

A thickness of the charge-transporting layer is appropriately selected depending on the intended purpose without any restriction, but it is preferably 5 μm to 40 μm, more preferably 10 μm to 30 μm.

<Substrate>

The substrate is appropriately selected depending on the intended purpose without any restriction, provided that it has a conductivity of $10^{10}$ Ω·cm or lower based on the volume resistivity. Examples of the substrate include: a film-shaped or cylindrical plastic or paper coated with a metal (e.g. aluminum, nickel, chromium, nichrome, copper, gold, silver, platinum) or a metal oxide (e.g. tin oxide, indium oxide) by vacuum deposition or sputtering; and a tube which is formed by forming a tube one or more plates of aluminum, aluminum alloy, nickel, stainless steel into a tube by extrusion, or drawing out, then subjecting the tube to surface treatment such as cutting, super-finishing, and polishing. Moreover, an endless nickel belt, and an endless stainless steel belt disclosed in JP-A No. 52-36016 can be also used as the substrate.

Other than the above, those formed by coating a conductive powder, which is dispersed in an appropriate binder resin, onto the aforementioned substrate can also be used as the substrate for used in the present invention.

Examples of the conductive powder include: conductive carbon-based powder such as carbon black and acetylene black;

metal powder such as aluminum, nickel, iron, nichrome, copper, zinc, and silver; and metal oxide powder such as conductive tin oxide, and ITO. Moreover, examples of the binder resin used together with the conductive powder include thermoplastic resins, thermoset resins, and photocurable resins, and specific examples thereof include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyacrylate resins, phenoxy resins, polycarbonate resins, cellulose acetate resins, ethylcellulose resins, polyvinyl butyral resins, polyvinyl formal resins, polyvinyltoluene resins, poly-N-vinyl carbazole, acrylic resins, silicone resins, epoxy resins, melamine resins, urethane resins, phenol resins, and alkyd resins.

Such conductive layer can be provided by coating a coating liquid prepared by dispersing the conductive powder and binder resin mentioned above in an appropriate solvent such as tetrahydrofuran, dichloromethane, methylethyl ketone, and toluene.

Moreover, as the substrate for use in the present invention, those providing a conductive layer on an appropriate cylindrical substrate using a thermal shrinkable tube in which the aforementioned conductive powder is added to a material such as polyvinyl chloride, polypropylene, polyester, polystyrene, polyvinylidene chloride, polyethylene, chlorinated rubber, and Teflon (registered trade mark) may be also suitably used.

In the electrophotographic photoconductor of the present invention, an intermediate layer may be provided between the charge-transporting layer and the crosslinked charge-transporting layer for preventing the substances of the charge-transporting layer from mixing into the crosslinked charge-transporting layer, or improving the adhesion between the charge-transporting layer and the crosslinked charge-transporting layer.

Therefore, as the intermediate layer, a layer that is insoluble or hardly soluble to the coating liquid of the crosslinked charge-transporting layer is suitable, and the intermediate layer generally contains a binder resin as a main component. Examples of the resin include polyamide, alcohol-soluble nylon, water-soluble polyvinyl butyral, polyvinyl butyral, and polyvinyl alcohol. As the forming method of the intermediate layer, the coating mentioned above is employed. The thickness of the intermediate layer is appropriately selected depending on the intended purpose without any restriction, but it is preferably 0.05 μm to 2 μm.

<Undercoat Layer>

In the electrophotographic photoconductor of the present invention, an undercoat layer may be provided between the substrate and the photosensitive layer (e.g., the photosensitive layer consisting of the charge-generating layer and the charge-transporting layer). The undercoat layer generally contains a resin as a main substance. Such resin is preferably a resin having high resistance to common organic solvent, as the photosensitive layer will be provided (i.e. coated) on the undercoat layer using a solvent. Examples of the resin include: water-soluble resins such as polyvinyl alcohol, casein, polyacrylic acid sodium; alcohol-soluble resins such as copolymer nylon, and methoxymethylated nylon; and curable resins capable of forming three-dimensional network structures, such as polyurethane, melamine resins, phenol resins, alkyd-melamine resins, and epoxy resins. Moreover, the undercoat layer may contain a powdery pigment of metal oxide such as titanium oxide, silica, alumina, zirconium oxide, tin oxide, and indium oxide for preventing formations of interference fringes, and reducing residual potential.

As the undercoat layer, those provided with $Al_2O_3$ by anodic oxidation, or those formed by a vacuum thin film forming method using an organic material such as polyoparaxylylene (parylene), or an inorganic material such as $SiO_2$, $SnO_2$, $TiO_2$, ITO, and $CeO_2$ are suitably used. Other than the above, conventional undercoat can be used as the undercoat layer.

The undercoat layer can be formed with an appropriate solvent by an appropriate coating method. In the undercoat layer, moreover, a silane-coupling agent, a titanium-coupling agent, a chromium-coupling agent or the like may be used.

The thickness of the undercoat layer is appropriately selected depending on the intended purpose without any restriction, but it is preferably 0 μM to 5 μM.

In the electrophotographic photoconductor of the present invention, an antioxidant may be added to each of the crosslinked charge-transporting layer, the charge-transporting layer, the charge-generating layer, the undercoat layer, the intermediate layer, and the like, for improving resistance to the environment, especially for preventing lowering of the sensitivity, and increase of the residual potential.

Examples of the antioxidant include a phenol compound, paraphenylene diamines, hydroquinones, an organic sulfur compound, and an organic phosphorus compound. These may be used independently, or in combination.

Examples of the phenol compound include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocopherols.

Examples of the paraphenylene diamines include N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compound include dilauryl-3,3'-thiodipropionate, distearyl-3,3'-thiodipropionate, and ditetradecyl-3,3'-thiodipropionate.

Examples of the organic phosphorus compound include triphenylphosphine, tri(nonylphenyl)phosphine, tri(dinonylphenyl)phosphine, tricresylphosphine, and tri(2,4-dibutylphenoxy)phosphine.

Note that, these compounds have been known as the antioxidant for rubbers, plastics, oils and fats, and commercial products thereof are readily available.

The amount of the antioxidant for use is appropriately selected depending on the intended purpose without any restriction, but it is preferably 0.01% by mass to 10% by mass relative to the total mass of the layer to which the antioxidant is added.

(Image Forming Method and Image Forming Apparatus)

The image forming method of the present invention contains at least: charging a surface of an electrophotographic photoconductor; exposing the charged surface of the electrophotographic photoconductor to light to form a latent electrostatic image; developing the latent electrostatic image with a toner to form a visible image; transferring the visible image to a recording medium; and fixing the transferred visible image on the recording medium, and may further contain other steps, if necessary.

The image forming apparatus of the present invention contains at least an electrophotographic photoconductor, a charging unit configured to charge a surface of the electrophotographic photoconductor, an exposing unit configured to expose the charged surface of the electrophotographic photoconductor to light to form a latent electrostatic image, a developing unit configured to develop the latent electrostatic image with a toner to form a visible image, a transferring unit configured to transfer the visible image to a recording medium; and a fixing unit configured to fix the transferred visible image on the recording medium, and may further contain other units, if necessary.

The electrophotographic photoconductor is the electrophotographic photoconductor of the present invention.

The image forming method of the present invention can be suitably performed by the image forming apparatus of the present invention, the charging is suitably performed by the charging unit, the exposing is suitably performed by the exposing unit, the developing is suitably performed by the developing unit, the transferring is suitably performed by the transferring unit, the fixing is suitably performed by the fixing unit, and other steps mentioned above are suitably performed by other units mentioned above.

Examples of other steps mentioned above include a cleaning step, and a diselectrification step.

Examples of other units mentioned above include a cleaning unit, and a diselectrification unit.

The exposing preferably contains writing the latent electrostatic image on the electrophotographic photoconductor in a digital method.

The exposing unit preferably writes the latent electrostatic image on the electrophotographic photoconductor in a digital method.

The image forming method and image forming apparatus of the present invention are more specifically explained with reference to the drawings, hereinafter.

Figure 18:
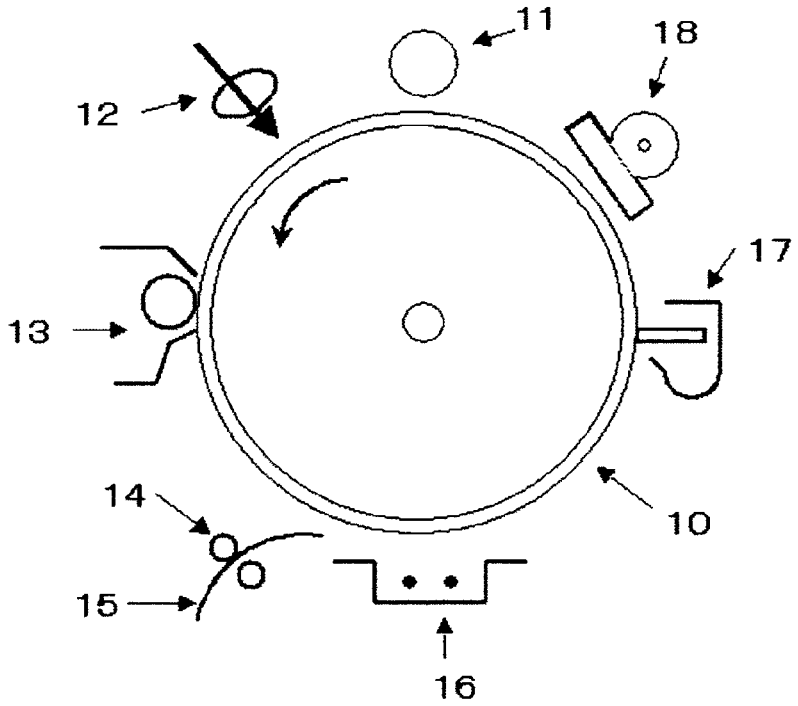
FIG. 18 is a schematic diagram for explaining an electrophotographic process and image forming apparatus of the present invention.

FIG. 18 is a schematic diagram for explaining the image forming method, and image forming apparatus of the present invention, and the following embodiment is also within the scope of the present invention.

The photoconductor (10) is rotated in the direction shown with the arrow presented in FIG. 18, and at the area surrounding the photoconductor (10), a charging member (11) serving as the charging unit, an imagewise exposing member (12) serving as the exposing unit, a developing member (13) serving as the developing unit, a transferring member (16) serving as the transferring unit, a cleaning member (17) serving as the cleaning unit, a diselectrification member (18) serving as the diselectrification unit, and the like are provided. There are cases where the cleaning member (17) and/or the diselectrification member (18) are omitted from the image forming apparatus.

Basic operations of the image forming apparatus are as follows.

The surface of the photoconductor (10) is uniformly charged by means of the charging member (11), followed by performing imagewise writing corresponding to an input signal by means of the imagewise exposing member (12) to thereby form a latent electrostatic image. Then, the latent electrostatic image is developed by the developing member (13), to thereby form a toner image on the surface of the photoconductor. The formed toner image is then transferred, by means of the transferring member (16), to transfer paper (15) serving as the recording medium, which has been sent to the transferring section by conveyance rollers (14). This toner image is then fixed on the transfer paper by means of a fixing device (not shown) serving as the fixing unit. Part of the toner, which has not been transferred to the transfer paper, is cleaned by the cleaning member (17). Then, the residual potential on the photoconductor (10) is diselectrificated by means of the diselectrification member (18) to thereby move on to a next cycle.

As shown in FIG. 18, the photoconductor (10) has a drum shape, but the photoconductor may be in the shape of a sheet, or an endless belt. As the charging member (11), and the transferring member (16), as well as a corotron, scorotron, and a solid state charger, a roller-shaped charging member, a brush-shaped charging member, and the like are used, and any of the conventional charging units can be used.

As the light sources of the imagewise exposing member (12), the diselectrification member (18), and the like, all luminous bodies such as fluorescent lamps, tungsten lamps, halogen lamps, mercury lamps, sodium lamps, light emitting diode (LED), laser diode (LD) (i.e. a semiconductor laser), and electroluminescence (EL) can be used.

Among them, the laser diode (LD) and the light emitting diode (LED) are mainly used. Various filters may be used for applying only the light having the predetermined wavelength, and such examples of the filters include a sharp-cut filter, a band-pass filter, a near IR-cut filter, a dichroic filter, an interference filter, and a color conversion filter.

Light is applied to the photoconductor (10) by the light source provided for the transferring step, diselectrifying step, cleaning step or exposing step. However, the application of light to the photoconductor (10) in the diselectrifying step largely gives fatigue to the photoconductor (10), especially which may reduce the charge, or increase residual potential.

Therefore, it is possible to diselectrify the photoconductor by applying reverse bias in the charging step or cleaning step, not by applying light, and such method for diselectrification may be advantageous for improving the resistance of the photoconductor.

When the electrophotographic photoconductor (10) is positively (negatively) charged to perform imagewise exposure, the positive (negative) electrostatic latent image is formed on the surface of the photoconductor. If this latent electrostatic image is developed with a toner (voltage detecting particles) of negative polarity (positive polarity), a positive image is obtained. If the image is developed with a toner of positive polarity (negative polarity), a negative image is obtained.

Methods known in the art are used for the operations of the developing unit and the diselectrifying unit.

Among the polluting materials attached to the surface of the photoconductor, discharge materials generated by charging, external additives contained the toner, and the like are easily influenced by humidity, and are factor for causing formation of deficient images. Paper powder is also one of the factors for formation of defected images, the attachment of the paper powder to the photoconductor causes not only formations of deficient images, but also deterioration of abrasion resistance, and partial abrasions. Therefore, the configuration that the photoconductor and the paper are not in contact with each other directly is preferable for improving the quality of the resulting images.

The toner used for developing the image on the photoconductor (10) by means of the developing member (13) is transferred to the transfer paper (15). However, all of the toner present on the photoconductor is not transferred, and some of the toner may remain on the photoconductor (10). Such residual toner is removed from the photoconductor (10) by the cleaning member (17).

As the cleaning member, the members known in the art, such as a cleaning blade and a cleaning brush are used. The cleaning blade and the cleaning brush are often used in combination.

Since the photoconductor of the present invention has high photosensitivity and high stability, it can be applied for a small-size photoconductor. The image forming apparatus or its system to which such photoconductor is more effectively applied is a tandem image forming apparatus. The tandem image forming apparatus is equipped with a plurality of photoconductors each corresponding to respective developing units each containing a toner of respective color, and these photoconductors and the developing units are operated so as to synchronize to each other. To the tandem image forming apparatus, at least four color toners, yellow (C), magenta (M), cyan (C), and black (K), which are necessary for full color printing, and developing units containing these toners are provided, as well as at least four photoconductors corresponding to these developing units. Having such configuration, such image forming apparatus can realize extremely high speed printing, compared with the printing speed of conventional image forming apparatus for full color printing.

Figure 19:
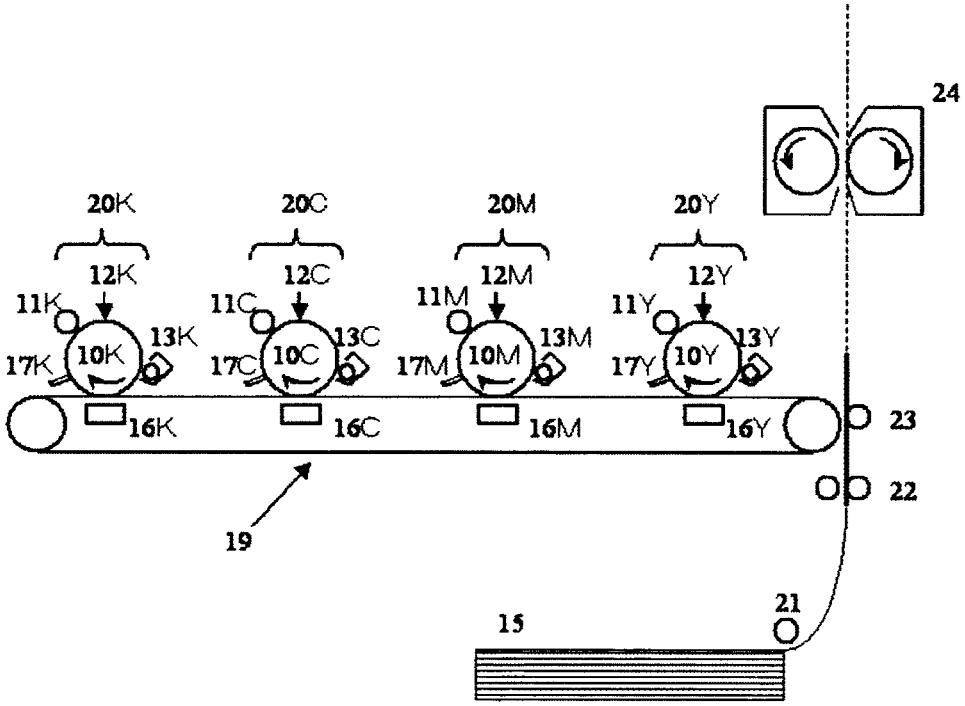
FIG. 19 is a schematic diagram for explaining a full color image forming apparatus using a tandem system as one example of the present invention.

FIG. 19 is a schematic diagram for explaining the full color tandem electrophotographic apparatus according to the present invention, and the example of the modification explained below is also within the scope of the present invention.

In FIG. 19, the photoconductors (10C (cyan)), (10M (magenta)), (10Y (yellow)), and (10K (black)) are each a drum-shaped photoconductor (10), and these photoconductors (10C, 10M, 10Y, and 10K) are each rotated in the direction shown with the arrow in the diagram. At the surrounding area of each photoconductor, at least a respective charging member (11C, 11M, 11Y, or 11K) serving as the charging unit, developing member (13C, 13M, 13Y, or 13K) serving as the developing unit, and cleaning member (17C, 17M, 17Y, or 17K) serving as the cleaning unit are provided in the rotational order.

Laser light (12C, 12M, 12Y, and 12K) is applied to the photoconductors (10C, 10M, 10Y, and 10K) from the exposing members (not shown), respectively, in the manner that the light is applied to the area on the back side of the photoconductor, which is present between the charging members (11C, 11M, 11Y, and 11K) and the developing members (13C, 13M, 13Y, and 13K), to form latent electrostatic images on the photoconductors (10C, 10M, 10Y, and 10K), respectively.

Four image forming elements (20C, 20M, 20Y, and 20K), each of which is configured to have such photoconductor (10C, 10M, 10Y, or 10K) in center, are aligned parallel to the transferring conveyance belt (19).

The transferring conveyance belt (19) is provided so as to be in contact with the sections of the photoconductors (10C, 10M, 10Y, and 10K) each of which is provided in the section between the developing member (13C, 13M, 13Y, or 13K) of each image forming element (20C, 20M, 20Y, or 20K) and the cleaning member (17C, 17M, 17Y, or 17K), and transferring members (16C, 16M, 16Y, and 16K) for applying transferring bias are provided on the other side (the back surface) of the transferring conveyance belt (19) to the side where the photoconductors (10) are provided. The difference between the image forming elements (20C, 20M, 20Y, and 20K) is color of the toner housed in the developing unit, and other configurations are the same in the all image forming elements.

The image forming operations of the color electrophotographic apparatus having the configurations as shown in FIG. 19 are performed in the following manner. At first, in each image forming element (20C, 20M, 20Y, or 20K), the photoconductor (10C, 10M, 10Y, or 10K) is charged by the charging member (11C, 11M, 11Y, or 11K) which is rotated in the same direction to the rotational direction of the photoconductor (10), and latent electrostatic images, each of which is corresponded to the respective color of the image to be formed, are formed by laser light (12C, 12M, 12Y, and 12K) applied from the exposing member (not shown) provided at outer side of the photoconductor (10).

Next, the formed electrostatic latent images are developed with the developing members (13C, 13M, 13Y, and 13K) to form toner images. The developing members (13C, 13M, 13Y, and 13K) are developing members each perform developing the toner of C (cyan), M (magenta), Y (yellow), or K (black), and the toner images each having a single color of C (cyan), M (magenta), Y (yellow), or K (black) respectively formed on the four photoconductors (10C, 10M, 10Y, and 10K) are superimposed on the transferring belt (19).

The transfer paper (15) is fed from the tray by means of the feeding roller (21), and then temporarily stopped by a pair of registration rollers (22) so that the transfer paper (15) is sent to the transferring member (23) so as to meet the timing to the image formation on the photoconductor. The toner image held on the transferring belt (19) is transferred to the transfer paper (15) by the electric field generated by the potential difference between the transferring bias applied to the transferring member (23) and the transferring belt (19). The toner image transferred onto the transfer paper (15) is conveyed and fixed thereon by the fixing member (24), and the transfer paper bearing the fixed image is then discharged to the discharging unit (not shown). The residual toner remained on the photoconductors (10C, 10M, 10Y, and 10K) without being transferred by the transferring unit is collected by the cleaning members (17C, 17M, 17Y, and 17K) each provided in the respective image forming element.

The intermediate transferring system as shown in FIG. 19 is particularly effective for an image forming apparatus capable of full color printing. In this system, as a plurality of toner images are formed on an intermediate transferring member first, and then transferred to paper at the same time, and thus it is easy to control and prevent dislocations of colors, and is advantageous for attaining high quality images.

As the intermediate transferring member, intermediate transferring members of various materials and shapes, such as a drum shape and a belt shape are available. In the present invention, any of the conventional intermediate transferring members known in the art can be used, and use thereof is effective and useful for improving the durability of the photoconductor and improving the quality of the resulting images.

Note that, in the example shown with the diagram of FIG. 19, the image forming elements are aligned in the order of C (cyan), M (magenta), Y (yellow), and K (black) from the upstream to downstream with respect to the transfer paper conveying direction. However, the arrangement of the image forming elements is not necessarily limited to this order, and the order of the colors can be appropriately arranged. Moreover, it is particularly effective for the present invention to provide a mechanism that the image forming elements (20C, 20M, and 20Y) other than that of black is stopped when documents in the color of only black are formed.

The image forming apparatus of the tandem type as described above is capable of transferring a plurality of toner images at once, and therefore it can realize high speed full color printing.

However, such an image forming apparatus requires at least four photoconductors mounted therein, which results in a large size of the apparatus. Moreover, the image forming apparatus of this type has problems that there are a difference in the abraded amount of each photoconductor depending on the amount of the toner for use, which reduces color reproducibility, and forms defected images.

Compared to such conventional photoconductors, the photoconductor of the present invention can be applied as a photoconductor of a small diameter because the photoconductor of the present invention has high photosensitivity and high stability. Moreover, in the case where a plurality of the photoconductors of the present invention is used in the image forming apparatus of the tandem type, the difference in the used amount of four photoconductors is small because influences from the increase in the residual potential, deterioration of sensitivity, or the like are reduced, and full color images with excellent color reproducibility can be provided even after the photoconductors are repeatedly used for a long period of time.

The image forming apparatus as described above may be fixed and incorporated in copying devices, facsimiles, and printers, or may be incorporated therein in the form of a process cartridge.

(Process Cartridge)

The process cartridge of the present invention contains an electrophotographic photoconductor, and at least one selected from the group consisting of a charging unit, an exposing unit, a developing unit, a transferring unit, a cleaning unit, and a diselectrification unit, and is detachably mounted in a main body of an image forming apparatus.

The electrophotographic photoconductor as mentioned is the electrophotographic photoconductor of the present invention.

The charging unit, exposing unit, developing unit, transferring unit, cleaning unit, and diselectrification unit are appropriately selected depending on the intended purpose without any restriction, and examples thereof include each unit listed in the descriptions of the image forming apparatus of the present invention.

Figure 20:
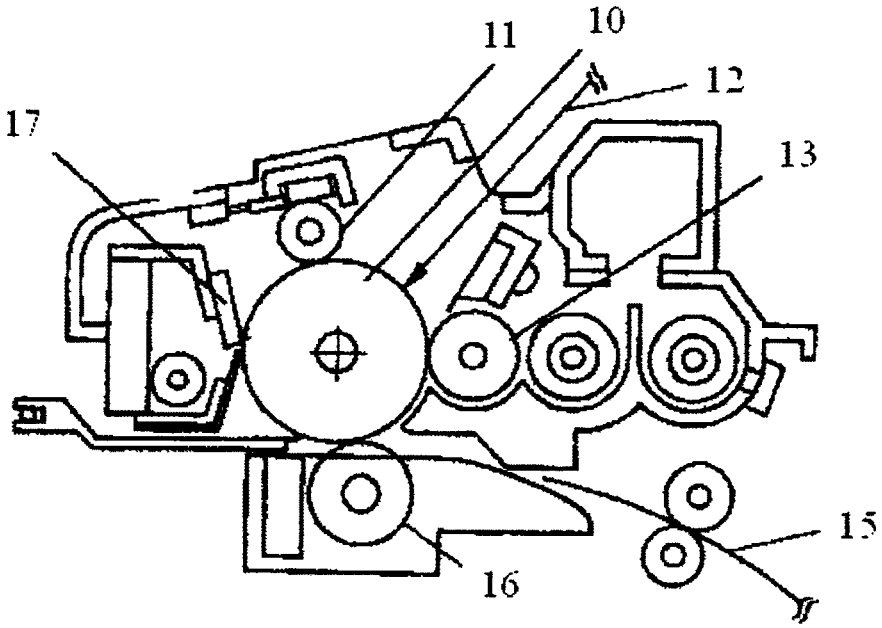
FIG. 20 is a diagram illustrating one example of the process cartridge of the present invention.

As illustrated in FIG. 20, the process cartridge a device (a component) equipped with a photoconductor (10), and containing, other than the photoconductor (10), a charging member (11) serving as the charging unit, an imagewise exposing member (12) serving as the exposing unit, a developing member (13) serving as the developing unit, a transferring member (16) serving as the transferring unit, a cleaning member (17) serving as the cleaning unit, and a diselectrification member serving as the diselectrification unit.

EXAMPLES

The present invention will be more specifically explained with Synthesis Examples and Evaluation Examples hereinafter, but these examples shall not be construed as limiting the scope of the present invention.

Note that, all the term "part(s)" in Examples means "part(s) by mass". Moreover, in the reaction formulae of Synthesis Examples, "Et" represents an ethyl group, "Bu" represents a butyl group, "Ac" represents an acetyl group, and "MFA" represents N-methylformanilide.

Synthesis Example of Methylol Compound (Compound A)

Synthesis Example 1

Synthesis of Exemplary Compound 1

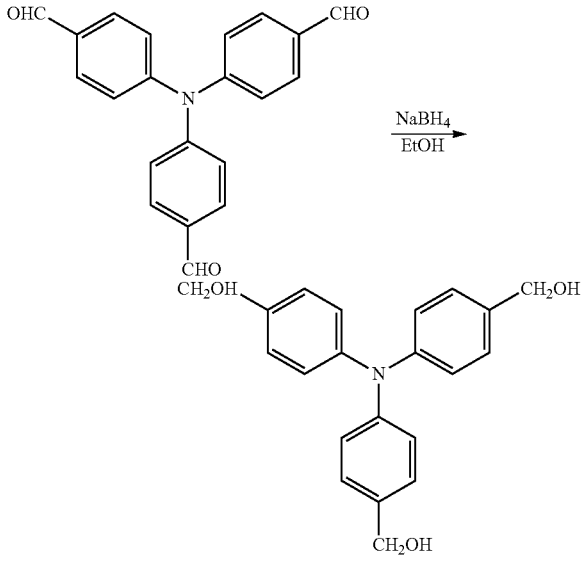

A four-necked flask was charged with 3.29 g of the intermediate aldehyde compound represented by the structure shown in the left of the reaction formula above, and 50 mL of ethanol. The mixture was stirred at room temperature, and 1.82 g of sodium borohydride was added to the mixture. The resulting mixture was continuously stirred for 12 hours. The resultant was extracted with ethyl acetate, dehydrated with magnesium sulfate, and subjected an absorption treatment using activated clay and silica gel. The obtained product was filtered, washed, and condensed to thereby yield a crystal material. The crystal material was dispersed in n-hexane, and the resulting dispersion was filtered, washed, and dried, to thereby yield a target compound (the compound represented by the structure shown in the right of the reaction formula above). The obtained compound had the yield of 2.78 g, and it was in the form of white crystals. The IR absorption spectrum thereof is shown in FIG. 1.

Synthesis Example 2

Synthesis of Starting Material (Exemplary Compound 11) of Production Intermediate Aldehyde Compound of Exemplary Compound 2

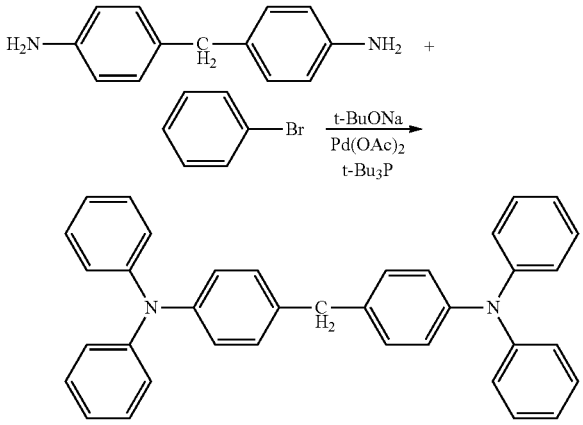

A four-necked flask was charged with 19.83 g of 4,4'-diaminodiphenylmethane, 69.08 g of bromobenzene, 2.24 g of palladium acetate, 46.13 g of tert-butoxy sodium, and 250 mL of o-xylene. The mixture was stirred under the argon gas atmosphere at room temperature. To this, 8.09 g of tri-tert-butylphosphine was added dropwise. The resultant was continuously stirred over 1 hour at 80° C., followed by stirring for 1 hour under reflux. The resultant was diluted with toluene, and to this solution, magnesium sulfate, activated clay, and silica gel were added, followed by stirring the mixture.

Figure 2:
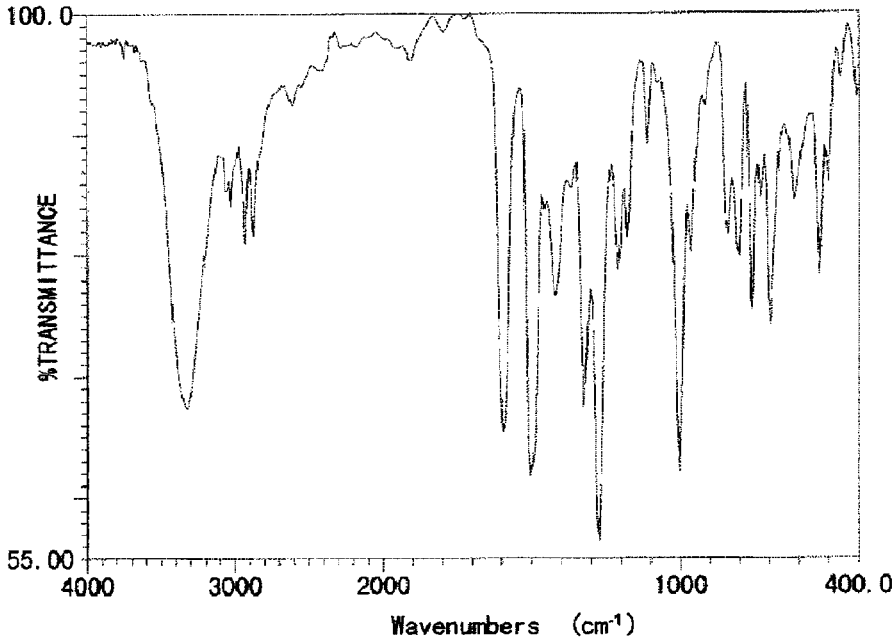
FIG. 2 is an IR absorption spectrum diagram (the KBr pellet technique) of the compound obtained in Synthesis Example 2, the transverse axis indicate the wave number ($cm^{-1}$), and the ordinate axis indicates the transmittance (%).

After performing filtration, washing, and concentration, a crystal material was obtained. The crystal material was dispersed in methanol, followed by filtration, washing, and drying, to thereby yield a target compound (the compound having the structure represented in the right of the reaction formula above). The obtained product had the yield of 45.73 g, and it was in the form of a pale yellow powder. The IR absorption spectrum thereof is shown in FIG. 2.

Synthesis Example 3

Synthesis of Production Intermediate Aldehyde Compound of Exemplary Compound 2

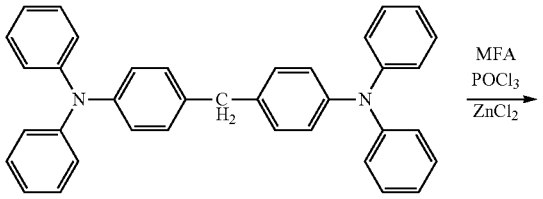

-continued

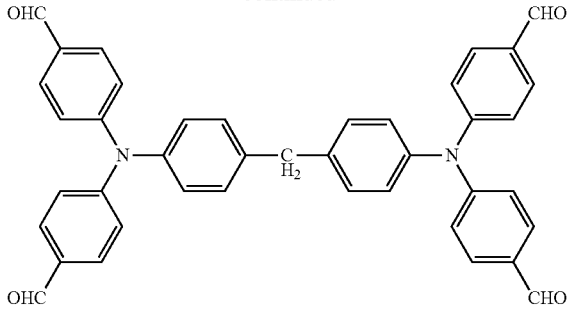

A four-necked flask was charged with 30.16 g of the starting material of the intermediate represented by the structure shown in the left of the reaction formula above, 71.36 g of N-methylformanilide (MFA), and 400 mL of o-dichlorobenzene. The mixture was stirred under the argon gas atmosphere at room temperature. To this, 82.01 g of phosphorous oxychloride was added dropwise. The resultant was heated to 80° C., and stirred, followed by adding 32.71 g of zinc chloride dropwise. The resultant was stirred at 80° C. for approximately 10 hours, followed by stirring at 120° C. for approximately 3 hours. To this mixture, a potassium hydroxide solution was added to thereby proceed to a hydrolysis reaction. The resultant was extracted with dichloromethane, dehydrated with magnesium sulfate, and subjected an absorption treatment using activated clay. The obtained product was filtered, washed, and condensed to thereby yield a crystal material.

Figure 3:
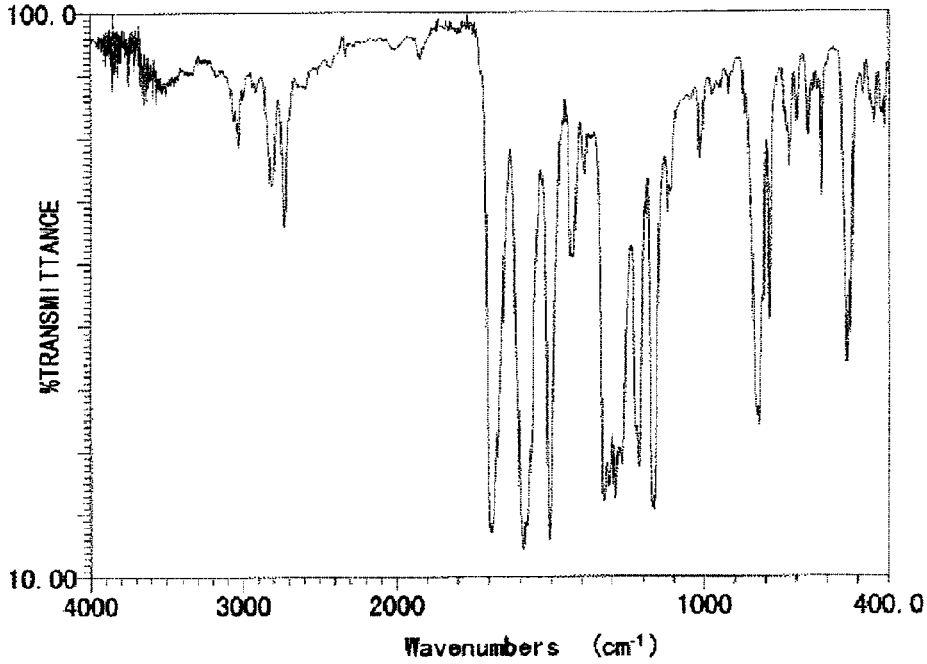
FIG. 3 is an IR absorption spectrum diagram (the KBr pellet technique) of the compound obtained in Synthesis Example 3, the transverse axis indicate the wave number ($cm^{-1}$), and the ordinate axis indicates the transmittance (%).

The obtained crystal material was purified by silica gel column purification (toluene/ethyl acetate=8/2 (mass ratio)), and then isolated. The crystal material obtained by the purification was recrystallized in methanol/ethyl acetate, to thereby yield a target compound (the compound represented by the structure shown in the right of the reaction formula above). The obtained compound had the yield of 27.80 g, and it was in the form of a yellow powder. The IR absorption spectrum thereof is shown in FIG. 3.

Synthesis Example 4

Synthesis of Exemplary Compound 2

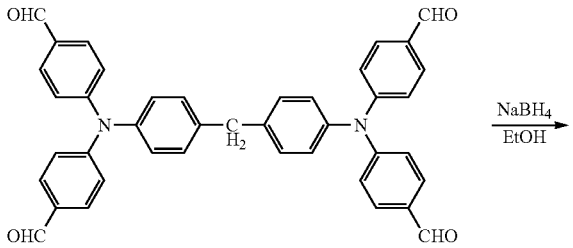

-continued

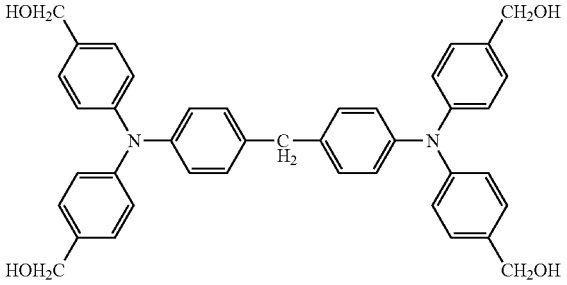

A four-necked flask was charged with 12.30 g of the intermediate aldehyde compound represented by the structure shown in the left of the reaction formula above, and 150 mL of ethanol. The mixture was stirred at room temperature, and 3.63 g of sodium borohydride was added to the mixture. The resulting mixture was continuously stirred for 4 hours. The resultant was extracted with ethyl acetate, dehydrated with magnesium sulfate, and subjected an absorption treatment using activated clay and silica gel. The obtained compound was filtered, washed, and condensed to thereby yield an amorphous material.

Figure 4:
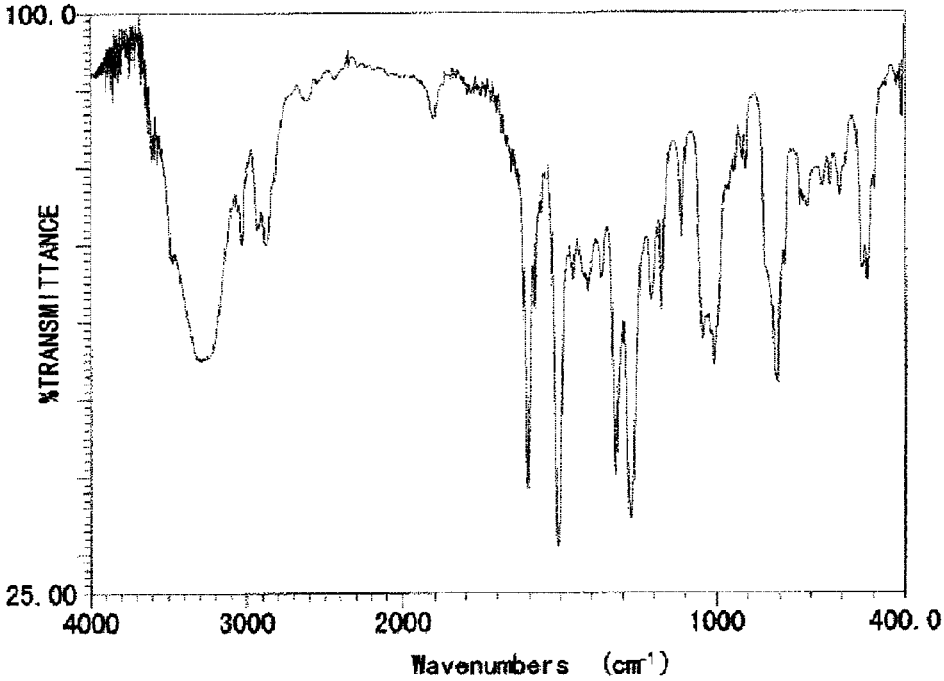
FIG. 4 is an IR absorption spectrum diagram (the KBr pellet technique) of the compound obtained in Synthesis Example 4, and the transverse axis indicate the wave number ($cm^{-1}$), and the ordinate axis indicates the transmittance (%).

The obtained amorphous material was dispersed in n-hexane, and the resulting dispersion was filtered, washed, and dried, to thereby yield a target compound (the compound represented by the structure shown in the right of the reaction formula above). The obtained compound had the yield of 12.0 g, and it was in the form of pale yellow amorphous. The IR absorption spectrum thereof is shown in FIG. 4.

Synthesis Example 5

Synthesis of Starting Material (Exemplary Compound 12) of Production Intermediate Aldehyde Compound of Exemplary Compound 3

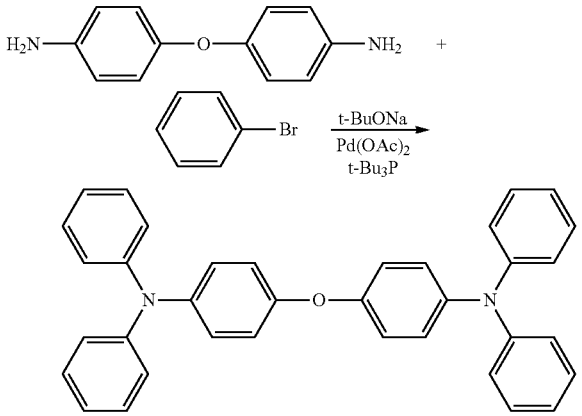

Figure 5:
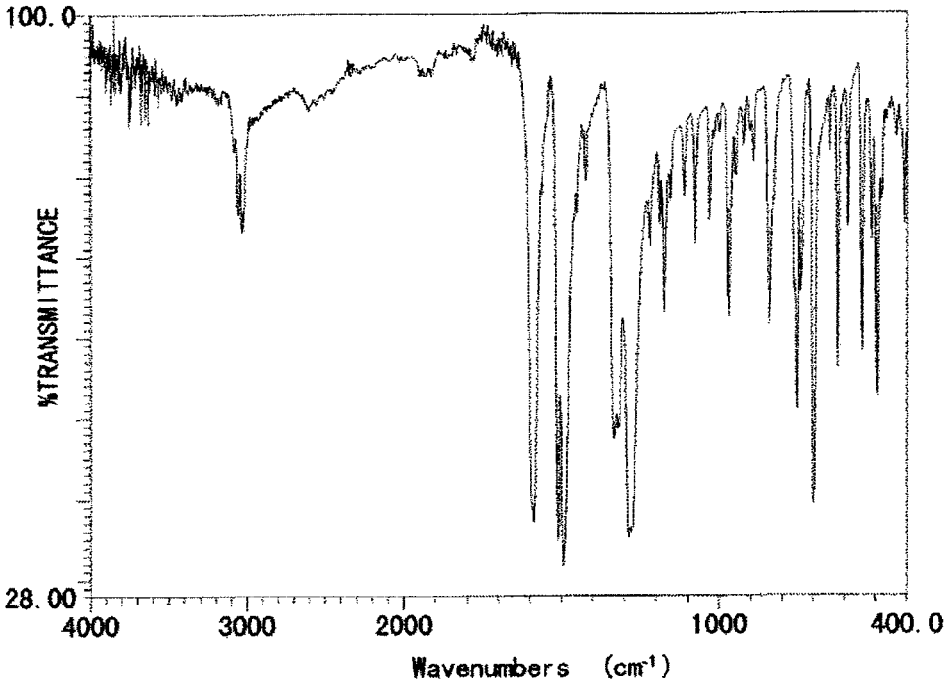
FIG. 5 is an IR absorption spectrum diagram (the KBr pellet technique) of the compound obtained in Synthesis Example 5, and the transverse axis indicate the wave number ($cm^{-1}$), and the ordinate axis indicates the transmittance (%).

A four-necked flask was charged with 20.02 g of 4,4'-diaminodiphenylmethane, 69.08 g of bromobenzene, 0.56 g of palladium acetate, 46.13 g of tert-butoxy sodium, and 250 mL of o-xylene. The mixture was stirred under the argon gas atmosphere at room temperature. To this, 2.02 g of tri-tert-butylphosphine was added dropwise. The resultant was continuously stirred over 1 hour at 80° C., followed by stirring for 1 hour under reflux. The resultant was diluted with toluene, and to this solution, magnesium sulfate, activated clay, and silica gel were added, followed by stirring the mixture. After performing filtration, washing, and concentration, a crystal material was obtained. The obtained crystal material was dispersed in methanol, followed by filtration, washing, and drying, to thereby yield a target compound (the compound having the structure represented in the right of the reaction formula above). The obtained compound had the yield of 43.13 g, and it was in the form of a pale blown powder. The IR absorption spectrum thereof is shown in FIG. 5.

Synthesis Example 6

Synthesis of Production Intermediate Aldehyde Compound of Exemplary Compound 3

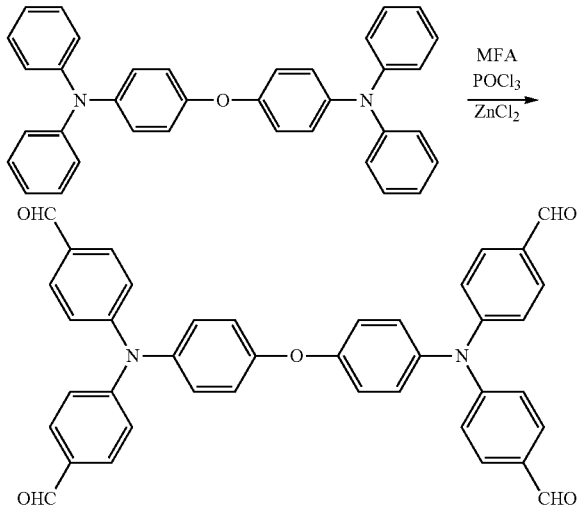

Figure 6:
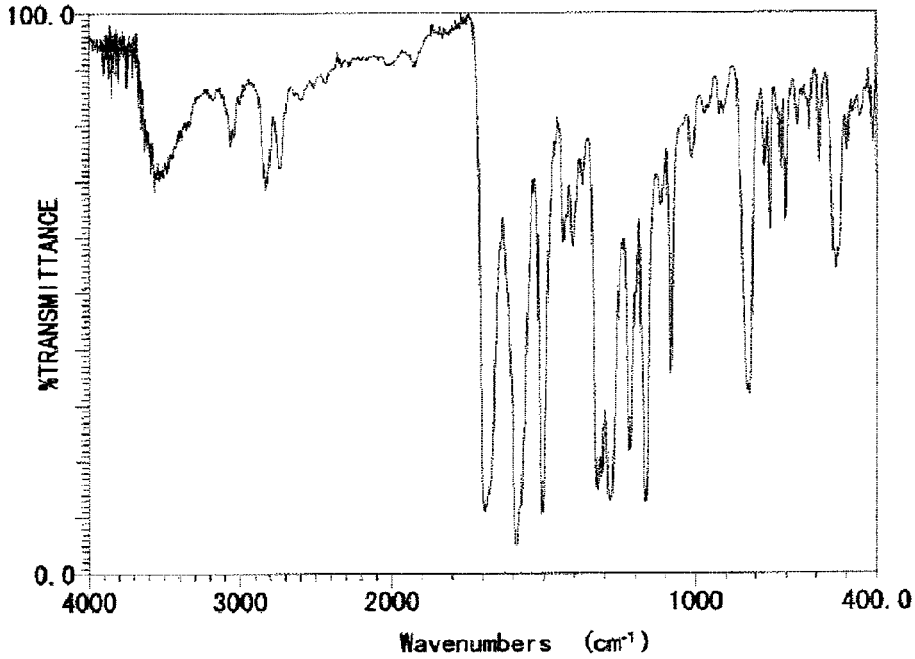
FIG. 6 is an IR absorption spectrum diagram (the KBr pellet technique) of the compound obtained in Synthesis Example 6, and the transverse axis indicate the wave number ($cm^{-1}$), and the ordinate axis indicates the transmittance (%).

A four-necked flask was charged with 30.27 g of the starting material of the intermediate represented by the structure shown in the left of the reaction formula above, 71.36 g of N-methylformanilide, and 300 mL of o-dichlorobenzene. The mixture was stirred under the argon gas atmosphere at room temperature. To this, 82.01 g of phosphorous oxychloride was added dropwise. The resultant was heated to 80° C., and stirred, followed by adding 16.36 g of zinc chloride dropwise. The resultant was stirred at 80° C. for 1 hour, followed by stirring at 120° C. for 4 hours, and stirring at 140° C. for 3 hours. To this mixture, a potassium hydroxide solution was added to thereby proceed to a hydrolysis reaction. The resultant was extracted with a toluene solvent, and to this, magnesium sulfate was added, followed by performing filtration, washing and concentration. The resultant was purified by column purification with toluene/ethyl acetate, followed by concentration, to thereby yield a crystal material. The obtained crystal material was dispersed in methanol, followed by filtration, washing, and drying, to thereby yield a target compound (the compound having the structure represented in the right of the reaction formula above). The obtained compound had the yield of 14.17 g, and it was in the form of a pale yellow powder. The IR absorption spectrum thereof is shown in FIG. 6.

Synthesis Example 7

Synthesis of Exemplary Compound 3

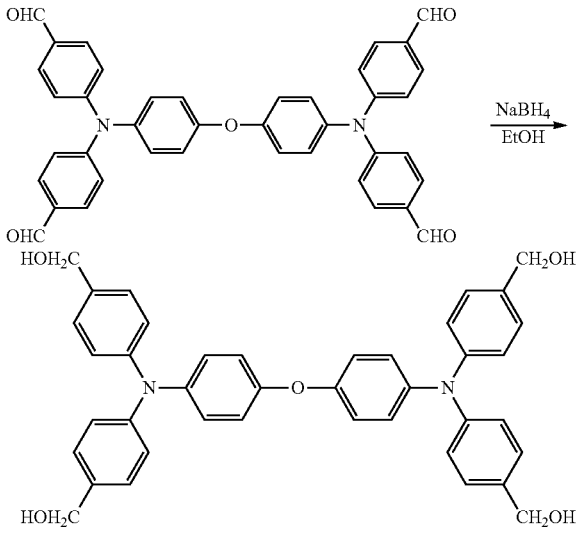

Figure 7:
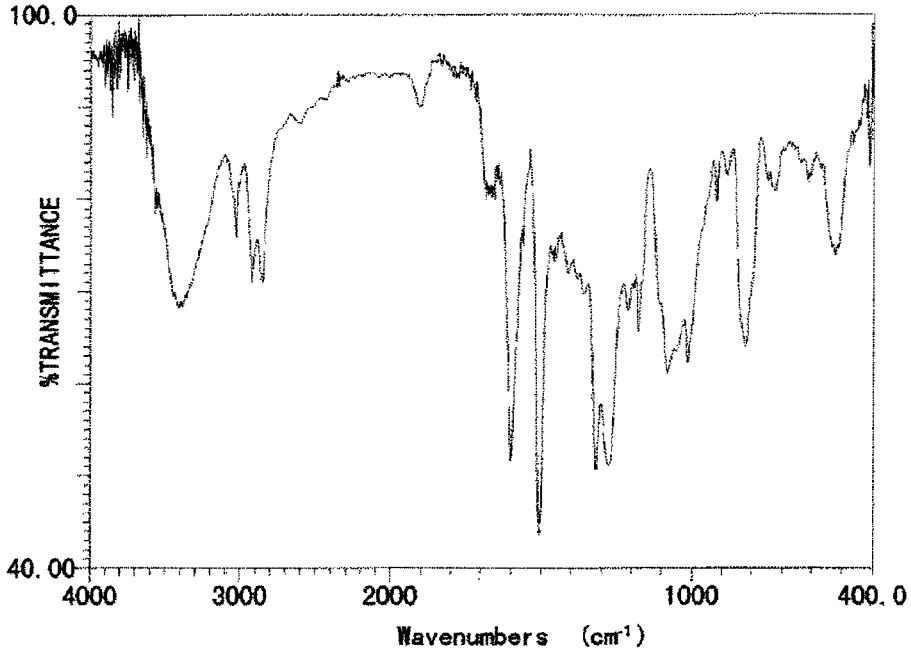
FIG. 7 is an IR absorption spectrum diagram (the KBr pellet technique) of the compound obtained in Synthesis Example 7, and the transverse axis indicate the wave number ($cm^{-1}$), and the ordinate axis indicates the transmittance (%).

A four-necked flask was charged with 6.14 g of the intermediate aldehyde compound represented by the structure shown in the left of the reaction formula above, and 75 mL of ethanol. The mixture was stirred at room temperature, and 1.82 g of sodium borohydride was added to the mixture. The resulting mixture was continuously stirred for 7 hours. The resultant was extracted with ethyl acetate, dehydrated with magnesium sulfate, and subjected an absorption treatment using activated clay and silica gel. The obtained compound was filtered, washed, and condensed to thereby yield an amorphous material. The obtained amorphous material was dispersed in n-hexane, and the resulting dispersion was filtered, wasnea, ana dried, to thereby yield a target compound (the compound represented by the structure shown in the right of the reaction formula above). The obtained compound had the yield of 5.25 g, and it was in the form of white amorphous. The IR absorption spectrum thereof is shown in FIG. 7.

Synthesis Example 8

Synthesis of Starting Material (Exemplary Compound 13) of Production Intermediate Aldehyde Compound of Exemplary Compound 4

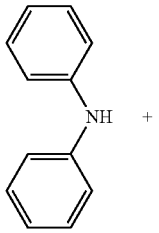

-continued

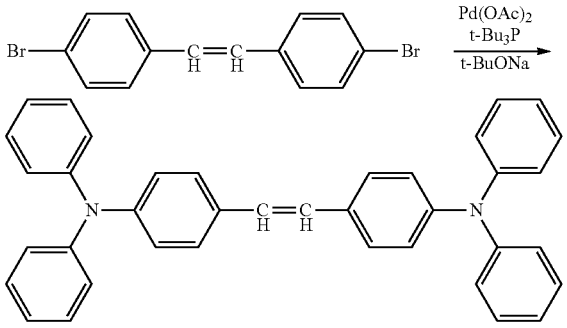

A four-necked flask was charged with 22.33 g of diphenyl amine, 20.28 g of dibromostilbene, 0.336 g of palladium acetate, 13.84 g of tert-butoxy sodium, and 150 mL of o-xylene. The mixture was stirred under the argon gas atmosphere at room temperature. To this, 1.22 g of tri-tert-butylphosphine was added dropwise. The resultant was continuously stirred over 1 hour at 80° C., followed by stirring for 2 hours under reflux. The resultant was diluted with toluene, and to this solution, magnesium sulfate, activated clay, and silica gel were added, followed by stirring the mixture. After performing filtration, washing, and concentration, a crystal material was obtained. The crystal material was dispersed in methanol, followed by filtration, washing, and drying, to thereby yield a target compound (the compound having the structure represented in the right of the reaction formula above). The obtained product had the yield of 29.7 g, and it was in the form of a pale yellow powder.

Figure 8:
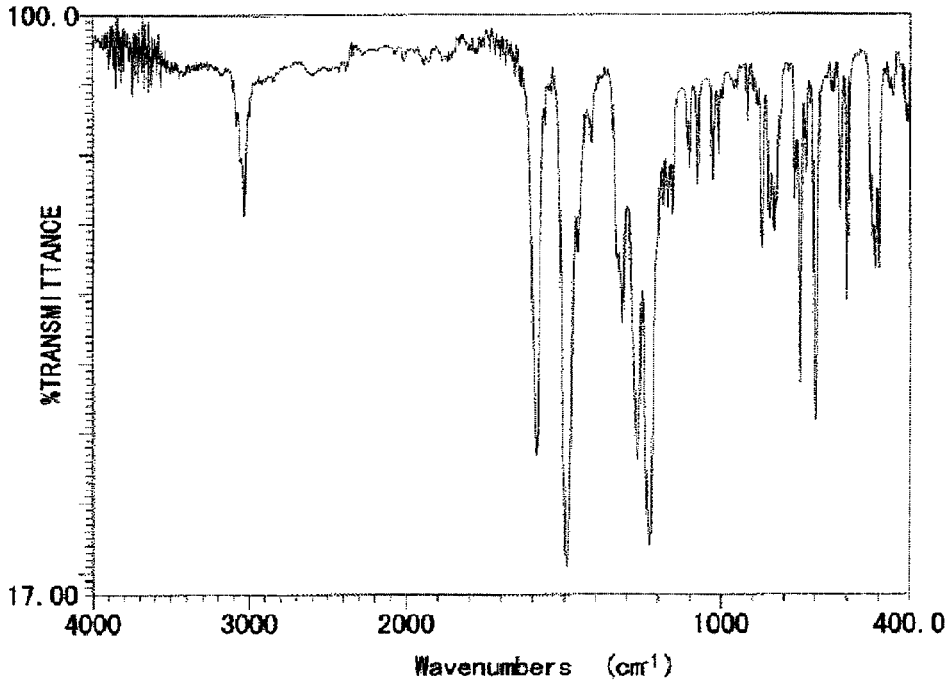
FIG. 8 is an IR absorption spectrum diagram (the KBr pellet technique) of the compound obtained in Synthesis Example 8, and the transverse axis indicate the wave number ($cm^{-1}$), and the ordinate axis indicates the transmittance (%).

The IR absorption spectrum thereof is shown in FIG. 8.

Synthesis Example 9

Synthesis of Production Intermediate Aldehyde Compound of Exemplary Compound 4

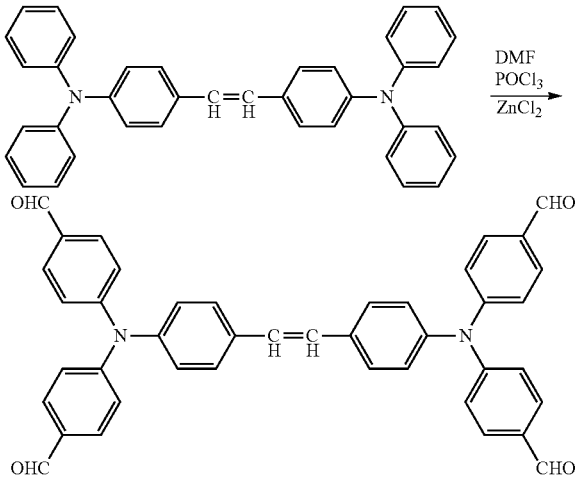

A four-necked flask was charged with 33.44 g of dehydrated dimethylformaldehyde, and 84.53 g of dehydrated toluene. The mixture was stirred in the iced water bath under the argon gas atmosphere. To this, 63.8 g of phosphorous oxychloride was slowly added dropwise. The resultant was continuously stirred for approximately 1 hour in the same situation. To this, a dehydrated toluene (106 g) solution of the starting material (26.76 g) of the intermediate represented by the structure shown in the left of the reaction formula above was slowly added dropwise. The resultant was continuously stirred over 1 hour at 80° C., followed by stirring for 5 hours under reflux. To this mixture, a potassium hydroxide solution was added to thereby proceed to a hydrolysis reaction. The resultant was extracted with toluene, dehydrated with magnesium sulfate, and concentrated. The obtained product was isolated by column purification (toluene/ethyl acetate=8/2 (mass ratio)). The purified material was dispersed in methanol, followed by filtration, washing, and drying, to thereby yield a target compound (the compound having the structure represented in the right of the reaction formula above). The obtained product had the yield of 16.66 g, and it was in the form of an orange powder.

Figure 9:
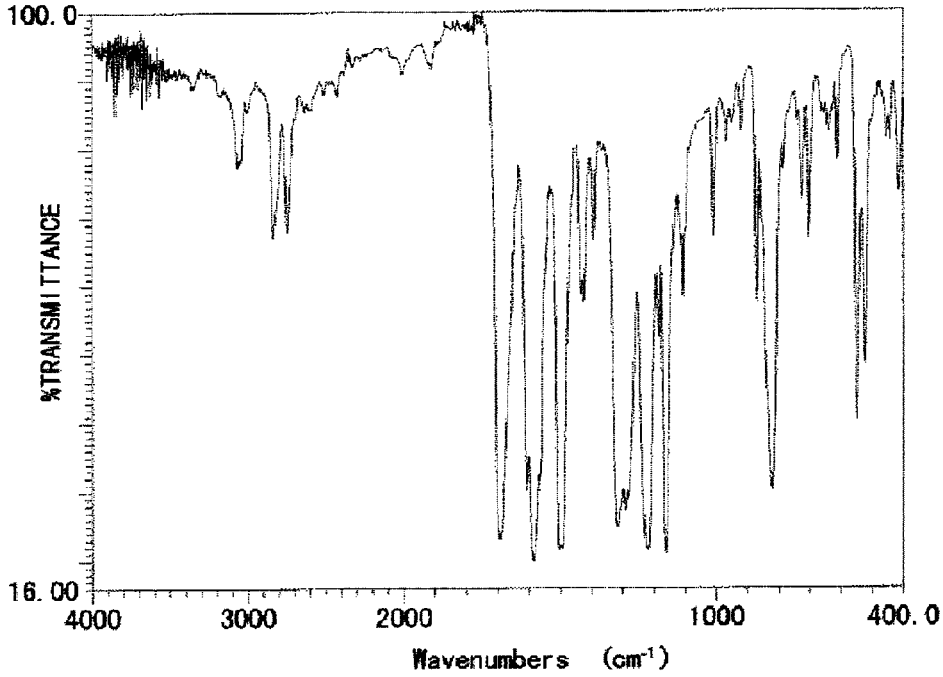
FIG. 9 is an IR absorption spectrum diagram (the KBr pellet technique) of the compound obtained in Synthesis Example 9, and the transverse axis indicate the wave number ($cm^{-1}$), and the ordinate axis indicates the transmittance (%).

The IR absorption spectrum thereof is shown in FIG. 9.

Synthesis Example 10

Synthesis of Exemplary Compound 4

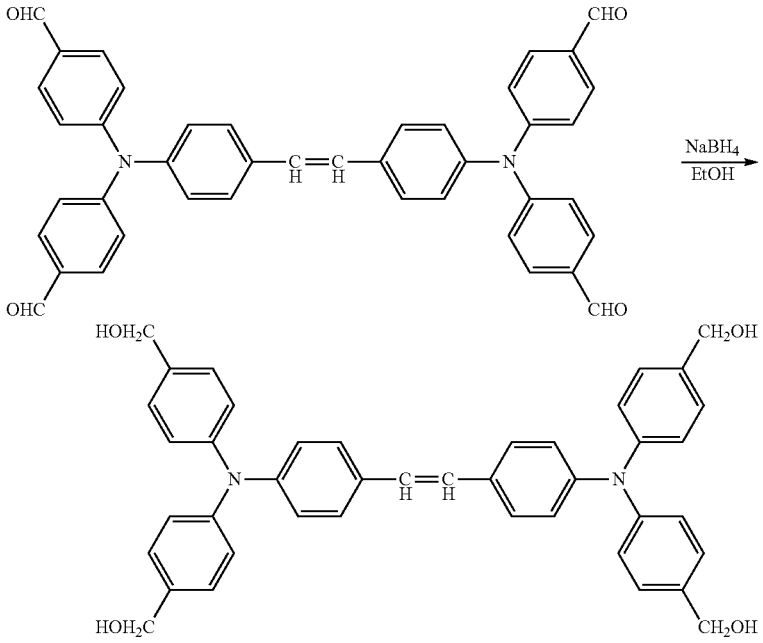

Figure 10:
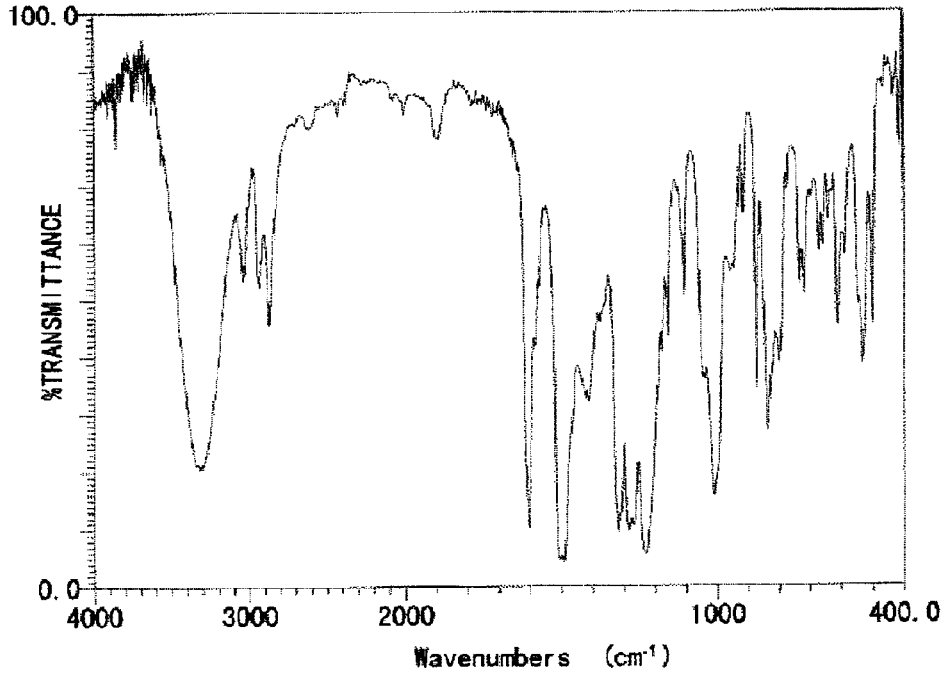
FIG. 10 is an IR absorption spectrum diagram (the KBr pellet technique) of the compound obtained in Synthesis Example 10, and the transverse axis indicate the wave number ($cm^{-1}$), and the ordinate axis indicates the transmittance (%).

A four-necked flask was charged with 6.54 g of the intermediate aldehyde compound represented by the structure shown in the left of the reaction formula above, and 75 mL of ethanol. The mixture was stirred at room temperature, and 1.82 g of sodium borohydride was added to the mixture. The resulting mixture was continuously stirred for 4 hours. The resultant was extracted with ethyl acetate, dehydrated with magnesium sulfate, and subjected an absorption treatment using activated clay and silica gel. The obtained compound was filtered, washed, and condensed to thereby yield an amorphous material. The obtained amorphous material was dispersed in n-hexane, and the resulting dispersion was filtered, washed, and dried, to thereby yield a target compound (the compound represented by the structure shown in the right of the reaction formula above). The obtained compound had the yield of 2.30 g, and it was in the form of yellow amorphous. The IR absorption spectrum thereof is shown in FIG. 10.

Synthesis Example 11

Synthesis of Starting Material (Exemplary Compound 14) of Production Intermediate Aldehyde Compound of Exemplary Compound 5

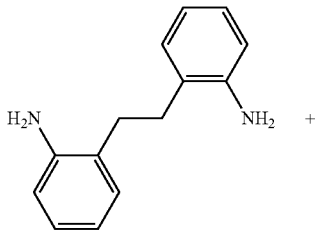

-continued

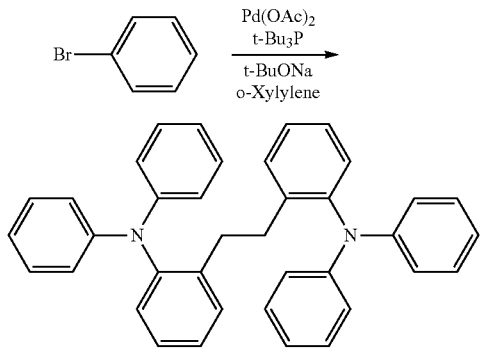

Figure 11:
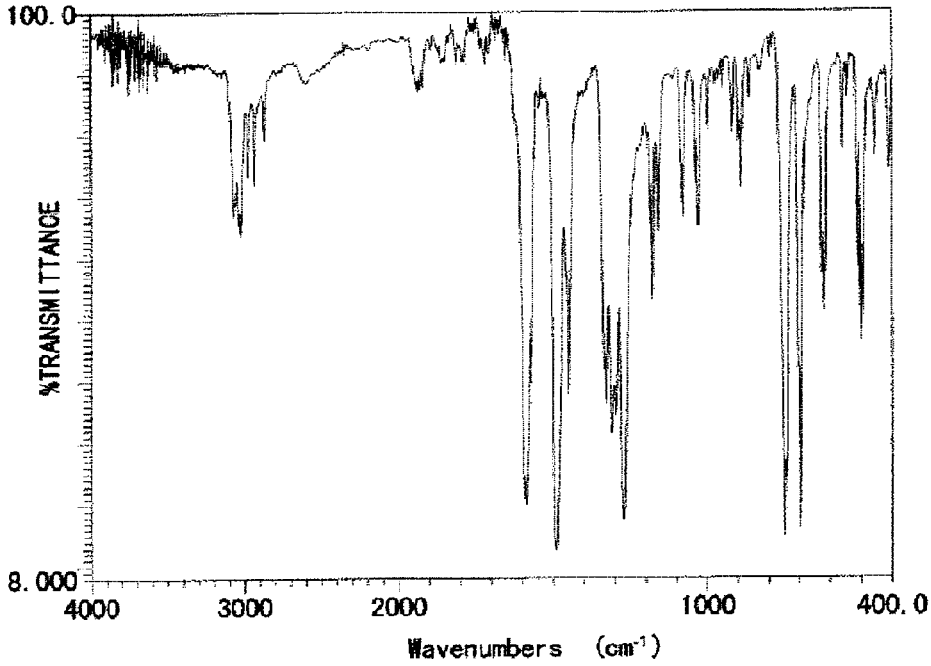
FIG. 11 is an IR absorption spectrum diagram (the KBr pellet technique) of the compound obtained in Synthesis Example 11, and the transverse axis indicate the wave number ($cm^{-1}$), and the ordinate axis indicates the transmittance (%).

A four-necked flask was charged with 21.23 g of 2,2'-ethylenedianiline, 75.36 g of bromobenzene, 0.56 g of palladium acetate, 6.13 g of tert-butoxy sodium, and 250 mL of o-xylene. The mixture was stirred under the argon gas atmosphere at room temperature. To this, 2.03 g of tri-tert-butylphosphine was added dropwise. The resultant was continuously stirred for 8 hours under reflux. The resultant was diluted with toluene, and to this solution, magnesium sulfate, and activated clay were added, followed by stirring the mixture at room temperature. After performing filtration, washing, and concentration, a crystal material was obtained. The obtained crystal material was dispersed in methanol, followed by filtration, washing, and drying, to thereby yield a target compound (the compound having the structure represented in the right of the reaction formula above). The obtained compound had the yield of 47.65 g, and it was in the form of a pale blown powder. The IR absorption spectrum thereof is shown in FIG. 11.

Synthesis Example 12

Synthesis of Production Intermediate Aldehyde Compound of Exemplary Compound 5

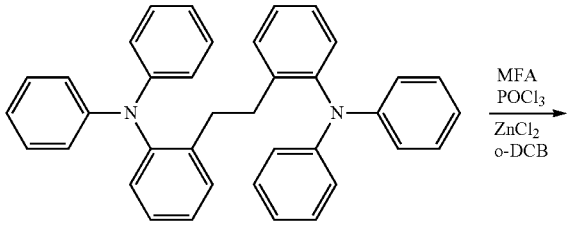

-continued

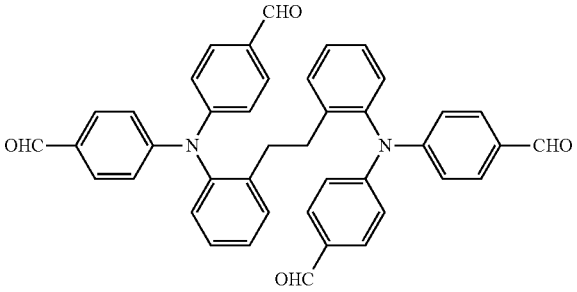

Figure 12:
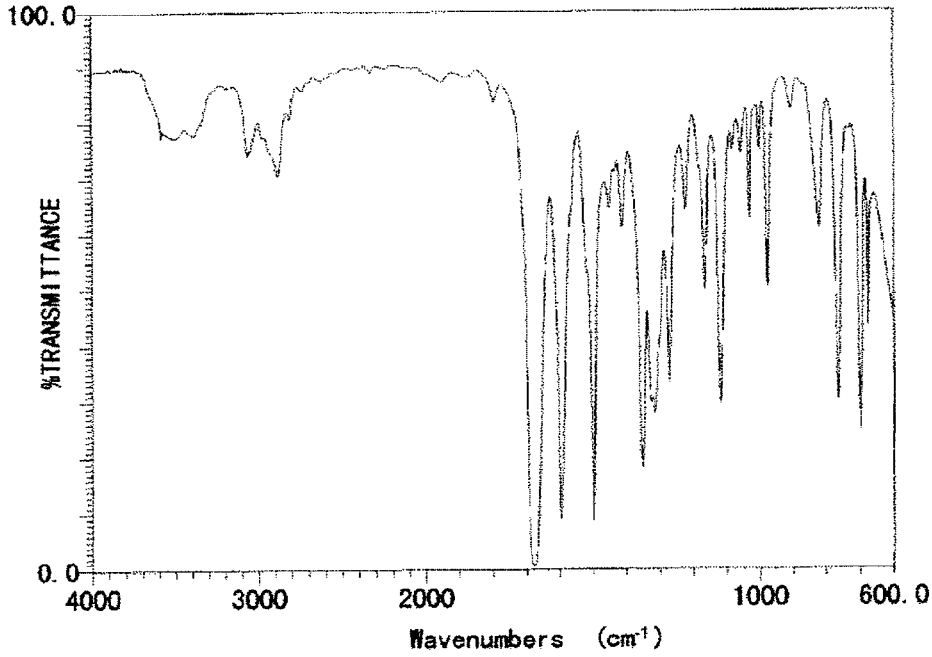
FIG. 12 is an IR absorption spectrum diagram (the KBr pellet technique) of the compound obtained in Synthesis Example 12, and the transverse axis indicate the wave number ($cm^{-1}$), and the ordinate axis indicates the transmittance (%).

A four-necked flask was charged with 31.0 g of the starting material donor of the intermediate represented by the structure shown in the left of the reaction formula above, 71.36 g of N-methylformanilide, and 400 mL of o-chlorobenzene. The mixture was stirred under the argon gas atmosphere at room temperature. To this, 82.01 g of phosphorous oxychloride was slowly added dropwise, and the mixture was heated to 80° C. To this, 32.71 g of zinc chloride was added, and the mixture was allowed to proceed to react for 1 hour at 80° C., followed by approximately 24 hours at 120° C. To the resulting reaction solution, a potassium hydroxide solution was added to thereby proceed to a hydrolysis reaction. The resultant was diluted with toluene, followed by washing with water. An oil phase thereof was dehydrated with magnesium chloride, adsorbed by activated clay and silica gel, followed by performing filtration, washing, and concentration, to thereby yield a target compound (the compound represented by the structure shown in the right of the reaction formula above). The obtained compound had the yield of 22.33 g, and it was in the form of a yellow fluid. The IR absorption spectrum thereof is shown in FIG. 12.

Synthesis Example 13

Synthesis of Exemplary Compound 5

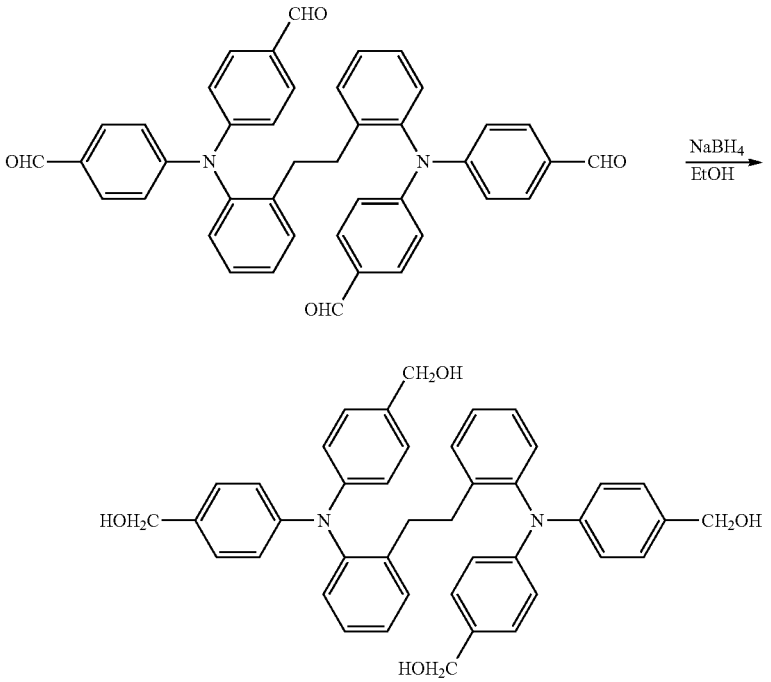

Figure 13:
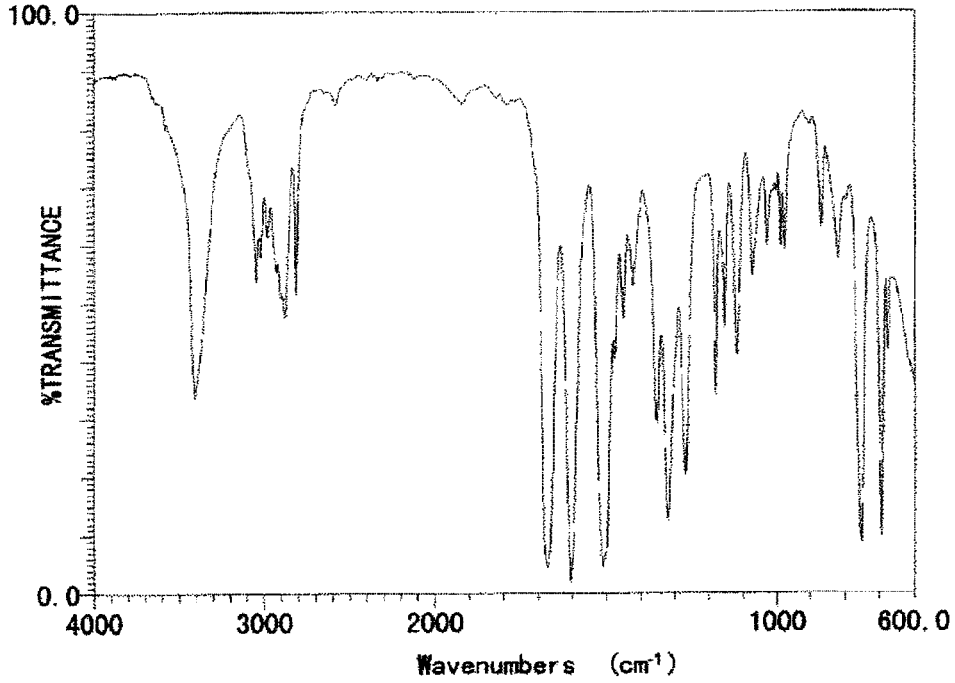
FIG. 13 is an IR absorption spectrum diagram (the KBr pellet technique) of the compound obtained in Synthesis Example 13, and the transverse axis indicate the wave number ($cm^{-1}$), and the ordinate axis indicates the transmittance (%).

A four-necked flask was charged with 9.43 g of the intermediate aldehyde compound represented by the structure shown in the left of the reaction formula above, and 100 mL of ethanol. The mixture was stirred at room temperature, and 2.72 g of sodium borohydride was added to the mixture. The resulting mixture was continuously stirred for 7 hours. The resultant was extracted with ethyl acetate, dehydrated with magnesium sulfate, and subjected an absorption treatment using activated clay and silica gel. The obtained material was filtered, washed, and condensed to thereby yield an amorphous material. The obtained amorphous material was dispersed in n-hexane, and the resulting dispersion was filtered, washed, and dried, to thereby yield a target compound (the compound represented by the structure shown in the right of the reaction formula above). The obtained compound had the yield of 8.53 g, and it was in the form of white amorphous. The IR absorption spectrum thereof is shown in FIG. 13.

As described above in connection with Synthesis Examples 1 to 13, it can be clearly seen that the aldehyde compound of the production intermediate can be easily produced, and Compound A (the methylol compound) can be easily produced by performing a reductive reaction of the aldehyde compound, which is used as the production intermediate.

Synthesis Example 14

Synthesis of Exemplary Compound 7

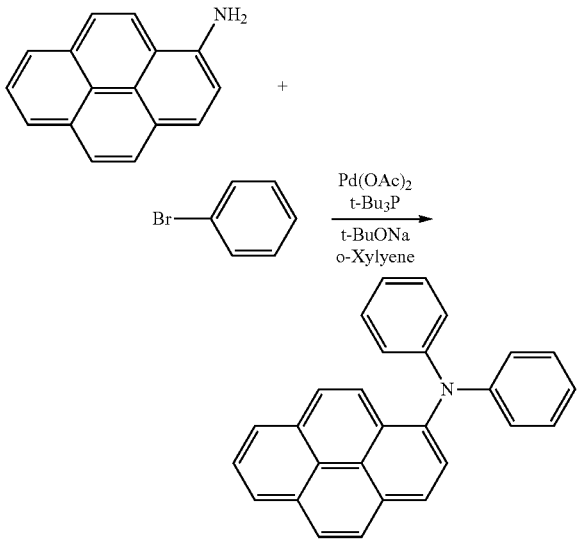

Figure 14:
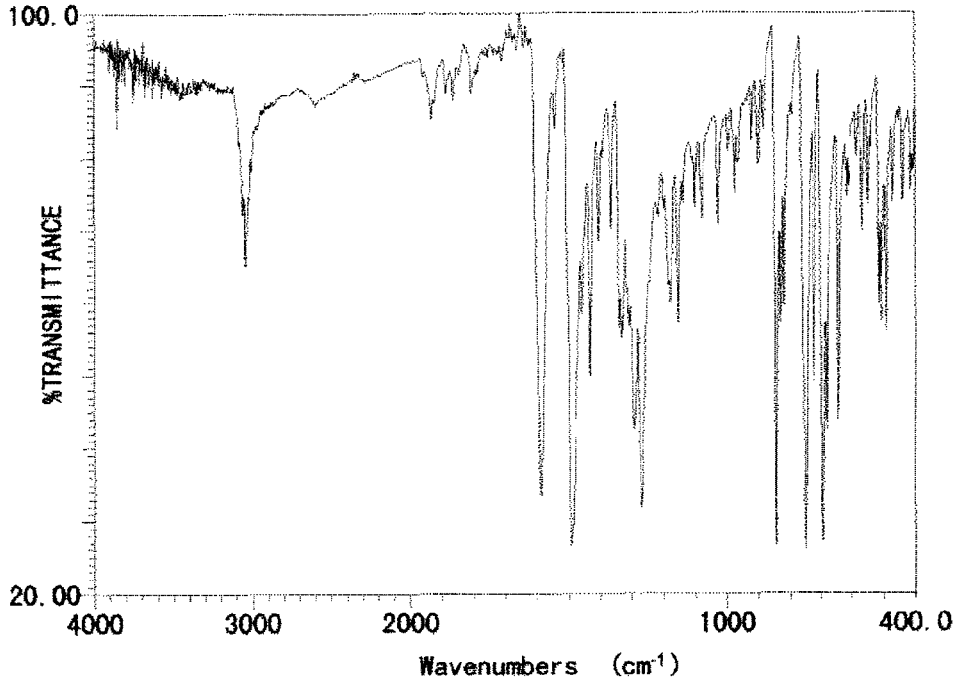
FIG. 14 is an IR absorption spectrum diagram (the KBr pellet technique) of the compound obtained in Synthesis Example 14, and the transverse axis indicate the wave number ($cm^{-1}$), and the ordinate axis indicates the transmittance (%).

A four-necked flask was charged with 5 g of 1-aminopyrene, 10 g of bromobenzene, 0.15 g of palladium acetate, 12.5 g of tert-butoxy sodium, and 50 mL of o-xylene. The mixture was stirred under the argon gas atmosphere at room temperature. To this, 0.55 g of tri-tert-butylphosphine was added dropwise. The resultant was continuously stirred for 8 hours under reflux. The resultant was diluted with toluene, and to this solution, magnesium sulfate, and activated clay were added, followed by stirring the mixture at room temperature, filtration, washing, and concentration, to thereby yield a crystal material. The obtained crystal material was dispersed in methanol, and the resulting dispersion was filtered, washed, and dried, to thereby yield a target compound (the compound represented by the structure shown in the right of the reaction formula above). The obtained compound had the yield of 6.85 g, and it was in the form of pale yellow crystals. The IR absorption spectrum thereof is shown in FIG. 14.

Synthesis Example 15

Synthesis of Exemplary Compound 8

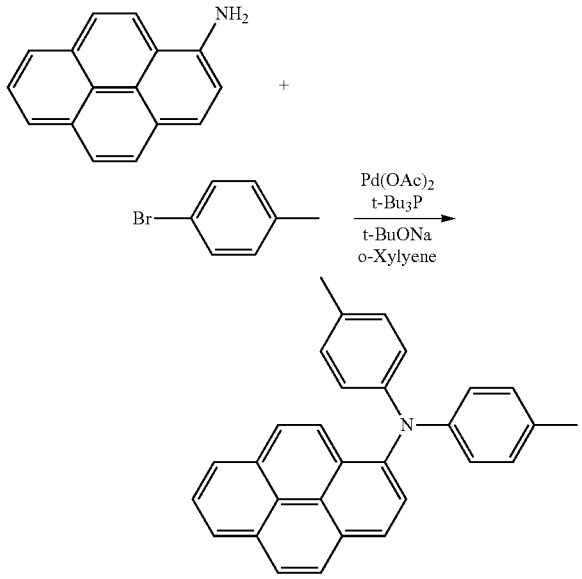

Figure 15:
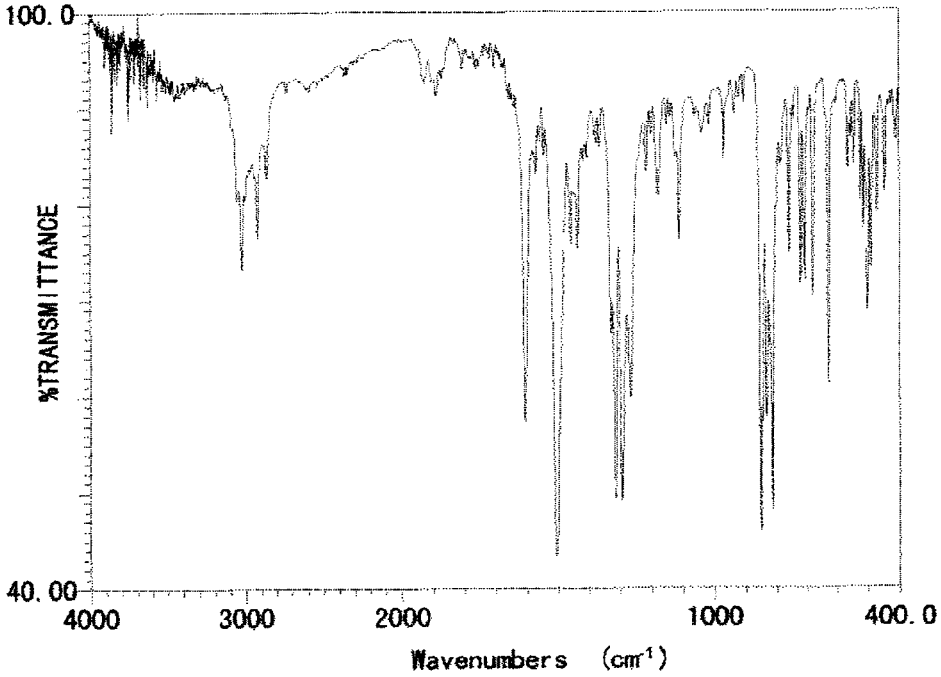
FIG. 15 is an IR absorption spectrum diagram (the KBr pellet technique) of the compound obtained in Synthesis Example 15, and the transverse axis indicate the wave number ($cm^{-1}$), and the ordinate axis indicates the transmittance (%).

A four-necked flask was charged with 5 g of 1-aminopyrene, 10 g of 4-bromotoluene, 0.15 g of palladium acetate, 12.5 g of tert-butoxy sodium, and 50 mL of o-xylene. The mixture was stirred under the argon gas atmosphere at room temperature. To this, 0.55 g of tri-tert-butylphosphine was added dropwise. The resultant was continuously stirred for 8 hours under reflux. The resultant was diluted with toluene, and to this solution, magnesium sulfate, and activated clay were added, followed by stirring the mixture at room temperature, filtration, washing, and concentration, to thereby yield a crystal material. The obtained crystal material was dispersed in methanol, and the resulting dispersion was filtered, washed, and dried, to thereby yield a target compound (the compound represented by the structure shown in the right of the reaction formula above). The obtained compound had the yield of 7.02 g, and it was in the form of pale yellow crystals. The IR absorption spectrum thereof is shown in FIG. 15.

Synthesis Example 16

Synthesis of Exemplary Compound 9

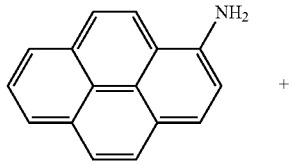

-continued

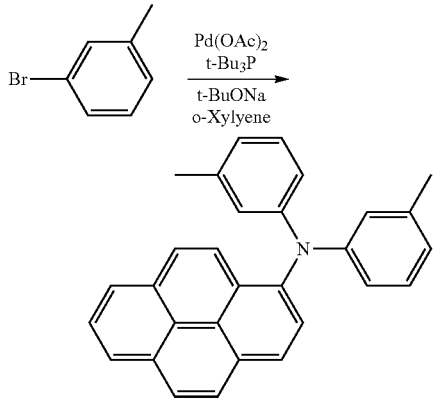

Figure 16:
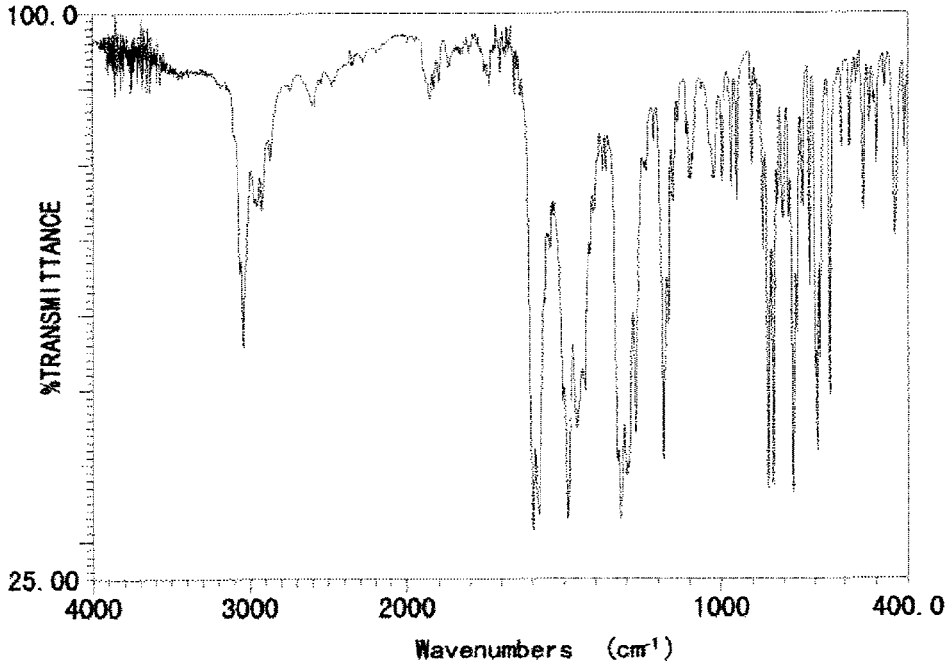
FIG. 16 is an IR absorption spectrum diagram (the KBr pellet technique) of the compound obtained in Synthesis Example 16, and the transverse axis indicate the wave number ($cm^{-1}$), and the ordinate axis indicates the transmittance (%).

A four-necked flask was charged with 5 g of 1-aminopyrene, 10 g of 3-bromotoluene, 0.15 g of palladium acetate, 12.5 g of tert-butoxy sodium, and 50 mL of o-xylene. The mixture was stirred under the argon gas atmosphere at room temperature. To this, 0.55 g of tri-tert-butylphosphine was added dropwise. The resultant was continuously stirred for 8 hours under reflux. The resultant was diluted with toluene, and to this solution, magnesium sulfate, and activated clay were added, followed by stirring the mixture at room temperature, filtration, washing, and concentration, to thereby yield a crystal material. The obtained crystal material was dispersed in methanol, and the resulting dispersion was filtered, washed, and dried, to thereby yield a target compound (the compound represented by the structure shown in the right of the reaction formula above). The obtained compound had the yield of 7.12 g, and it was in the form of pale yellow crystals. The IR absorption spectrum thereof is shown in FIG. 16.

Synthesis Example 17

Synthesis of Exemplary Compound 10

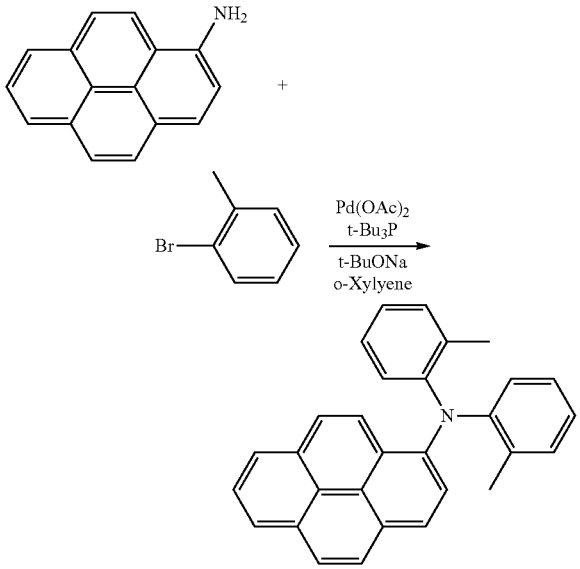

Figure 17:
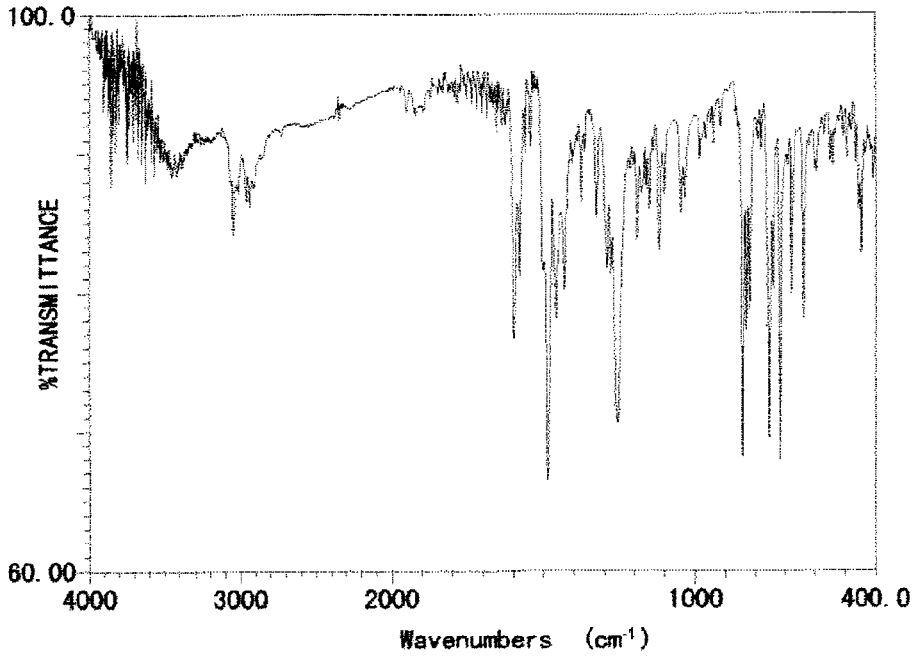
FIG. 17 is an IR absorption spectrum diagram (the KBr pellet technique) of the compound obtained in Synthesis Example 17, and the transverse axis indicate the wave number ($cm^{-1}$), and the ordinate axis indicates the transmittance (%).

A four-necked flask was charged with 5 g of 1-aminopyrene, 10 g of 2-bromotoluene, 0.15 g of palladium acetate, 12.5 g of tert-butoxy sodium, and 50 mL of o-xylene. The mixture was stirred under the argon gas atmosphere at room temperature. To this, 0.55 g of tri-tert-butylphosphine was added dropwise. The resultant was continuously stirred for 8 hours under reflux. The resultant was diluted with toluene, and to this solution, magnesium sulfate, and activated clay were added, followed by stirring the mixture at room temperature, filtration, washing, and concentration, to thereby yield a crystal material. The obtained crystal material was dispersed in methanol, and the resulting dispersion was filtered, washed, and dried, to thereby yield a target compound (the compound represented by the structure shown in the right of the reaction formula above). The obtained compound had the yield of 6.81 g, and it was in the form of pale yellow crystals. The IR absorption spectrum thereof is shown in FIG. 17.

Example 1

On an aluminum cylinder having a diameter of 30 mm, an undercoat layer coating liquid of the formulation below, a charge-generating layer coating liquid of the formulation below, and a charge-transporting layer coating liquid of the formulation below were sequentially applied and dried, to thereby form an undercoat layer having a thickness of 3.5 μm, a charge-generating layer having a thickness of 0.2 μm, and a charge-transporting layer having a thickness of 18 μm, respectively.

On the obtained charge-transporting layer, a crosslinked charge-transporting layer coating liquid of the formulation below was applied by spray coating, and dried at 135° C. for 30 minutes, to thereby form a crosslinked charge-transporting layer having a thickness of 5.0 μm. In the manner as mentioned, an electrophotographic photoconductor of Example 1 was produced.

[Formulation of Undercoat Layer Coating Liquid]

| | |
|---|---|
| Alkyd resin (BECKOZOLE 1307-60-EL, manufactured by DIC CORPORATION) | 6 parts |
| Melamine resin (SUPERBECKAMINE G-821-60, manufactured by DIC CORPORATION) | 4 parts |
| Titanium oxide | 40 parts |
| Methyl ethyl ketone | 50 parts |

[Formulation of Charge-Generating Layer Coating Liquid]

| | |
|---|---|
| Polyvinyl butyral (XYHL, manufactured by Union Carbide Corporation) | 0.5 parts |
| Cyclohexanone | 200 parts |
| Methyl ethyl ketone | 80 parts |
| Bisazo pigment represented by the following structural formula | 2.4 parts |

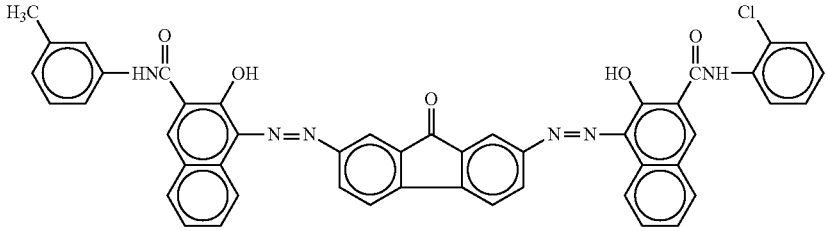

[Formulation of Charge-Transporting Layer Coating Liquid]

| | |
|---|---|
| Bisphenol Z Polycarbonate (Panlite ® TS-2050, manufactured by TEIJIN CHEMICALS LTD.) | 10 parts |
| Tetrahydrofuran | 100 parts |
| 1% by mass silicone oil tetrahydrofuran solution (KF50-100CS, manufactured by Shin-Etsu Chemical Co., Ltd.) | 0.2 parts |
| Low molecular charge-transporting material represented by the following structural formula | 7 parts |

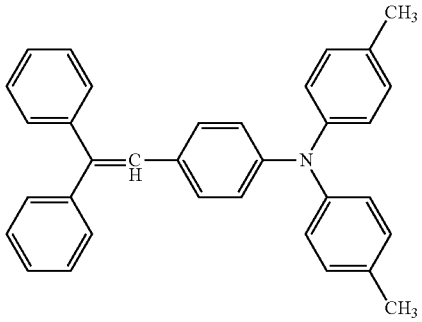

[Formulation of Crosslinked Charge-Transporting Layer Coating Liquid]

| | |
|---|---|
| Compound A: Exemplary Compound No. 1 | 10 parts |
| Compound B: Exemplary Compound No. 6 | 10 parts |
| Para toluene sulfonic acid | 0.02 parts |
| Tetrahydrofuran | 100 parts |

Example 2

An electrophotographic photoconductor was produced in the same manner as in Example 1, provided that Exemplary Compound No. 6 was replaced with Exemplary Compound No. 9 for Compound B.

Example 3

An electrophotographic photoconductor was produced in the same manner as in Example 1, provided that Exemplary Compound No. 6 was replaced with Exemplary Compound No. 12 for Compound B.

Example 4

An electrophotographic photoconductor was produced in the same manner as in Example 1, provided that Exemplary Compound No. 1 was replaced with Exemplary Compound No. 2 for Compound A.

Example 5

An electrophotographic photoconductor was produced in the same manner as in Example 1, provided that Exemplary Compound No. 1 was replaced with Exemplary Compound No. 4 for Compound A.

Example 6

An electrophotographic photoconductor was produced in the same manner as in Example 1, provided that Exemplary Compound No. 1 was replaced with Exemplary Compound No. 2 for Compound A, and Exemplary Compound No. 6 was replaced with Exemplary Compound No. 7 for Compound B.

Example 7

An electrophotographic photoconductor was produced in the same manner as in Example 1, provided that Exemplary Compound No. 1 was replaced with Exemplary Compound No. 2 for Compound A, and Exemplary Compound No. 6 was replaced with Exemplary Compound No. 8 for Compound B.

Example 8

An electrophotographic photoconductor was produced in the same manner as in Example 1, provided that Exemplary Compound No. 1 was replaced with Exemplary Compound No. 2 for Compound A, and Exemplary Compound No. 6 was replaced with Exemplary Compound No. 11 for Compound B.

Example 9

An electrophotographic photoconductor was produced in the same manner as in Example 1, provided that Exemplary Compound No. 1 was replaced with Exemplary Compound No. 2 for Compound A, and Exemplary Compound No. 6 was replaced with Exemplary Compound No. 12 for Compound B.

Example 10

An electrophotographic photoconductor was produced in the same manner as in Example 1, provided that Exemplary Compound No. 1 was replaced with Exemplary Compound No. 2 for Compound A, and Exemplary Compound No. 6 was replaced with Exemplary Compound No. 14 for Compound B.

Example 11

An electrophotographic photoconductor was produced in the same manner as in Example 1, provided that Exemplary Compound No. 1 was replaced with Exemplary Compound No. 3 for Compound A, and Exemplary Compound No. 6 was replaced with Exemplary Compound No. 13 for Compound B.

Example 12

An electrophotographic photoconductor was produced in the same manner as in Example 1, provided that Exemplary Compound No. 1 was replaced with Exemplary Compound No. 5 for Compound A, and Exemplary Compound No. 6 was replaced with Exemplary Compound No. 10 for Compound B.

Comparative Example 1

An electrophotographic photoconductor was produced in the same manner as in Example 1, provided that Exemplary Compound No. 1 was replaced with Compound (I) represented by the following structure, for Compound A.

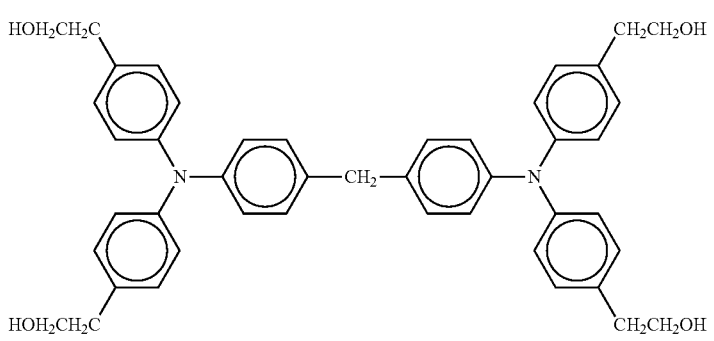

Compound (I)

Comparative Example 2

An electrophotographic photoconductor was produced in the same manner as in Example 1, provided that Exemplary Compound No. 6 was replaced with Compound (II) represented by the following structure, for Compound B.

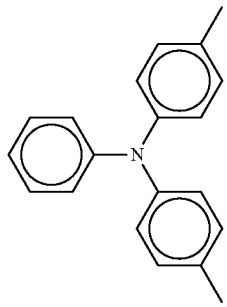

Compound (II)

<Measurement of Gel Fraction of Crosslinked Charge-Transporting Layer>

The gel fraction of the crosslinked charge-transporting layer was measured. The crosslinked charge-transporting layer coating liquid was directly applied to the aluminum substrate in the same manner as in Examples 1 to 12 and Comparative Examples 1 to 2, followed by heat drying to thereby form a film. The formed film was dipped in a tetrahydrofuran solution at 25° C. for 5 days. From the mass retention rate of the gel content of the crosslinked charge-transporting layer after the dipping, the gel fraction was calculated by the mathematical formula (1) presented below. The results are shown in Table 3.

Gel fraction (%)=100×(mass of cured product after dipping and drying/initial mass of cured product) Mathematical Formula (1)

TABLE 3

| | Compound A | Compound B | Gel fraction (%) |
|---|---|---|---|
| Ex. 1 | Exemplary Compound 1 | Exemplary Compound 6 | 90 |
| Ex. 2 | Exemplary Compound 1 | Exemplary Compound 9 | 88 |
| Ex. 3 | Exemplary Compound 1 | Exemplary Compound 12 | 89 |
| Ex. 4 | Exemplary Compound 2 | Exemplary Compound 6 | 98 |
| Ex. 5 | Exemplary Compound 4 | Exemplary Compound 6 | 95 |

TABLE 3-continued

| | Compound A | Compound B | Gel fraction (%) |
|---|---|---|---|
| Ex. 6 | Exemplary Compound 2 | Exemplary Compound 7 | 98 |
| Ex. 7 | Exemplary Compound 2 | Exemplary Compound 8 | 96 |
| Ex. 8 | Exemplary Compound 2 | Exemplary Compound 11 | 99 |
| Ex. 9 | Exemplary Compound 2 | Exemplary Compound 12 | 98 |
| Ex. 10 | Exemplary Compound 2 | Exemplary Compound 14 | 99 |
| Ex. 11 | Exemplary Compound 3 | Exemplary Compound 13 | 96 |
| Ex. 12 | Exemplary Compound 5 | Exemplary Compound 10 | 95 |
| Comp. Ex. 1 | (I) | Exemplary Compound 6 | 0 |
| Comp. Ex. 2 | Exemplary Compound 1 | (II) | 28 |

<Paper Feeding Test>

Next, the paper feeding test of 100,000 pieces of A4 size paper was performed using each of the electrophotographic photoconductors of Examples 1 to 12 and Comparative Examples 1 to 2, and a toner including silica external additives (volume average particle diameter of 9.5 μm, average circularity of 0.91).

At first, the electrophotographic photoconductor was mounted in a process cartridge, and a modified device of an image forming apparatus (imagioNeo 270, manufactured by Ricoh Company Limited) using a 655 nm semiconductor laser as a light source for image exposure was used, and electric potential on a dark area of the exposed photoconductor was set to 900 (−V). Printing was then performed continuously on 100,000 pieces of paper in total, and the image on the initial print and the image obtained after printing 100,000 pieces were evaluated. Moreover, the electric potential of the bright area was measured at the initial printing and after printing of 100,000 pieces with the luminous power of the image exposure light source being about 0.4 μJ/cm$^2$. Furthermore, the abraded amount was evaluated based on the difference between the film thickness at the initial printing and the film thickness after printing of 100,000 pieces. In addition, the image after the printing of 100,000 pieces was observed, and the number of white spots in the solid image area was counted. The results are shown in Tables 4-1 and 4-2.

TABLE 4-1

| | | | Initial | |
|---|---|---|---|---|
| | Compound A | Compound B | Potential of bright area (−V) | Image quality |
| Ex. 1 | Exemplary Compound 1 | Exemplary Compound 6 | 55 | Excellent |
| Ex. 2 | Exemplary Compound 1 | Exemplary Compound 9 | 45 | Excellent |
| Ex. 3 | Exemplary Compound 1 | Exemplary Compound 12 | 42 | Excellent |
| Ex. 4 | Exemplary Compound 2 | Exemplary Compound 6 | 40 | Excellent |
| Ex. 5 | Exemplary Compound 4 | Exemplary Compound 6 | 35 | Excellent |
| Ex. 6 | Exemplary Compound 2 | Exemplary Compound 7 | 40 | Excellent |
| Ex. 7 | Exemplary Compound 2 | Exemplary Compound 8 | 38 | Excellent |
| Ex. 8 | Exemplary Compound 2 | Exemplary Compound 11 | 29 | Excellent |
| Ex. 9 | Exemplary Compound 2 | Exemplary Compound 12 | 60 | Excellent |
| Ex. 10 | Exemplary Compound 2 | Exemplary Compound 14 | 57 | Excellent |
| Ex. 11 | Exemplary Compound 3 | Exemplary Compound 13 | 90 | Excellent |
| Ex. 12 | Exemplary Compound 5 | Exemplary Compound 10 | 70 | Excellent |
| Comp. Ex. 1 | (I) | Exemplary Compound 6 | 75 | Excellent |
| Comp. Ex. 2 | Exemplary Compound 1 | (II) | 84 | Excellent |

TABLE 4-2

| | After 100,000 prints | | | |
|---|---|---|---|---|
| | Potential of bright area (−V) | Image quality | Abrasion amount (μm) | White spots (number/100 cm$^2$) |
| Ex. 1 | 59 | Excellent | 3.1 | 10-15 |
| Ex. 2 | 49 | Excellent | 2.9 | 10-15 |

TABLE 4-2-continued

| | After 100,000 prints | | | |
|---|---|---|---|---|
| | Potential of bright area (−V) | Image quality | Abrasion amount (μm) | White spots (number/100 cm$^2$) |
| Ex. 3 | 48 | Excellent | 2.2 | 10-15 |
| Ex. 4 | 45 | Excellent | 0.8 | 0-5 |
| Ex. 5 | 40 | Excellent | 2.7 | 0-5 |
| Ex. 6 | 45 | Excellent | 0.7 | 0-5 |
| Ex. 7 | 40 | Excellent | 1.2 | 0-5 |
| Ex. 8 | 42 | Excellent | 1 | 0-5 |
| Ex. 9 | 80 | Excellent | 0.9 | 0-5 |
| Ex. 10 | 72 | Excellent | 0.5 | 0-5 |
| Ex. 11 | 130 | Low image density | 3.2 | 0-5 |
| Ex. 12 | 90 | Excellent | 4.1 | 10-15 |
| Comp. Ex. 1 | 102 | Low image density | 12 | 0-5 |
| Comp. Ex. 2 | 153 | Significantly low image density | 9 | >100 |

From the results shown in Tables 4-1 and 4-2, it was found that the electrophotographic photoconductors of Examples 1 to 12 had excellent abrasion resistance compared to organic photoconductors, which generally had high abrasion resistance, and could output images of less defects. Especially, the electrophotographic photoconductor of Examples 1 to 12 did not easily form white spots, which were caused by stuck silica on the photoconductor, and could maintain sufficient image stability for use of long period of time.

REFERENCE SIGNS LIST

10 photoconductor
11 charging member
12 imagewise exposing unit
13 developing member
14 transfer roller
15 transfer paper
16 transferring member
17 cleaning member
18 diselectrification member
10Y, 10M, 10C, 10K photoconductor
11Y, 11M, 11C, 11K charging member
12Y, 12M, 12C, 13K imagewise exposing unit (laser light)
13Y, 13M, 13C, 13K developing member
16Y, 16M, 16C, 16K transferring member
17Y, 17M, 17C, 17K cleaning member
19 transfer conveying belt
20Y, 20M, 20C, 20K image forming element
21 paper feeding roller
22 registration roller
23 transferring member (secondary transferring member)
24 fixing member

The invention claimed is:

1. An electrophotographic photoconductor, comprising:

a layer comprising a cured product obtained by crosslinking a compound comprising a charge-transporting group and three or more methylol groups, and a different compound comprising a charge-transporting group.

2. The electrophotographic photoconductor according to claim 1, wherein the compound comprising a charge-transporting group and three or more methylol groups is a N,N,N-trimethyloltriphenyl amine of structural formula (1):

Structural Formula (1)

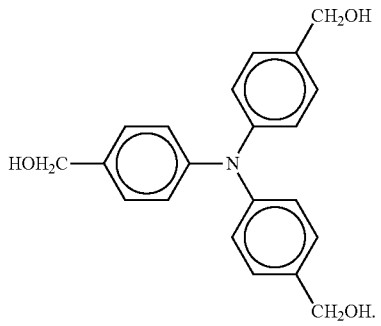

3. The electrophotographic photoconductor according to claim 1, wherein the compound comprising a charge-transporting group and three or more methylol groups is a compound of general formula (1):

General Formula (1)

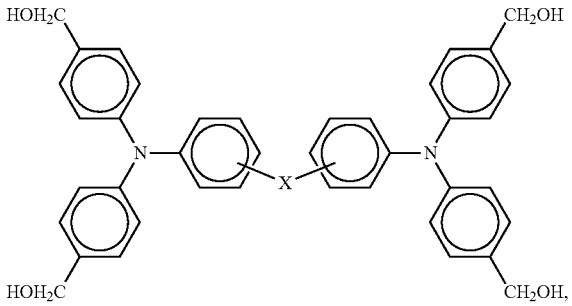

wherein X is —$CH_2$—, —O—, —CH═CH—, or —$CH_2CH_2$—.

4. The electrophotographic photoconductor according to claim 1, wherein the different compound comprising a charge-transporting group is a triphenyl amine of general formula (2):

General Formula (2)

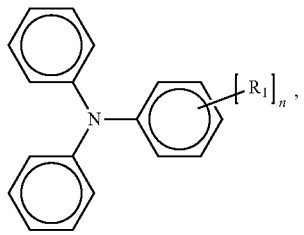

wherein $R_1$ is a hydrogen atom or a methyl group;

n is of from 1 to 4; and in the case where n is of from 2 to 4, $R_1$ may be identical or different.

5. The electrophotographic photoconductor according to claim 1, wherein the different compound is a compound of general formula (3):

General Formula (3)

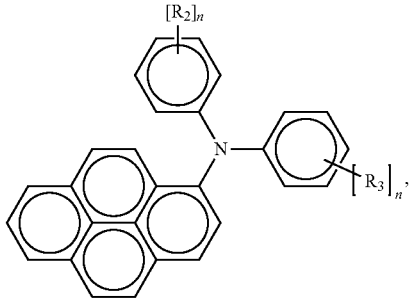

wherein $R_2$, and $R_3$ are each independently a hydrogen atom or a methyl group;

n is of from 1 to 4; and in the case where n is of from 2 to 4, $R_2$ may be identical or different and $R_3$ may be identical or different.

6. The electrophotographic photoconductor according to claim 1, wherein the different compound is a compound of general formula (4):

General Formula (4)

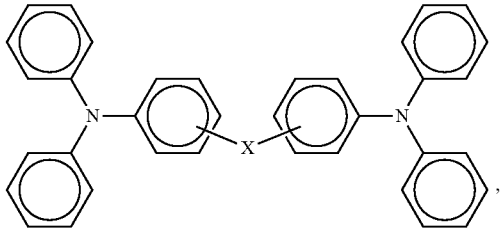

wherein X is —$CH_2$—, —O—, —CH═CH—, or —$CH_2CH_2$—.

7. The electrophotographic photoconductor according to claim 1, wherein the layer is an outermost layer of the electrophotographic photoconductor.

8. The electrophotographic photoconductor according to claim 7, further comprising:

a substrate;

a charge-generating layer above the substrate;

a charge-transporting layer above the charge-generating layer; and a crosslinked charge-transporting layer above the charge-transporting layer, wherein the crosslinked charge-transporting layer is the outermost layer.

9. An image forming method, comprising:

charging a surface of an electrophotographic photoconductor to obtain a charged surface;

exposing the charged surface of the electrophotographic photoconductor to light to form a latent electrostatic image;

developing the latent electrostatic image with a toner to form a visible image;

transferring the visible image to a recording medium; and fixing the transferred visible image on the recording medium, wherein the electrophotographic photoconductor comprises:

a layer comprising a cured product obtained by crosslinking a compound comprising a charge-transporting group and three or more methylol groups, and a different compound comprising a charge-transporting group.

10. The image forming method according to claim 9, wherein the exposing comprises writing the latent electrostatic image on the electrophotographic photoconductor with the light in a digital method.

11. The image forming method according to claim 9, wherein the compound comprising a charge-transporting group and three or more methylol groups is a N,N,N-trimethyloltriphenyl amine of structural formula (1):

Structural Formula (1)

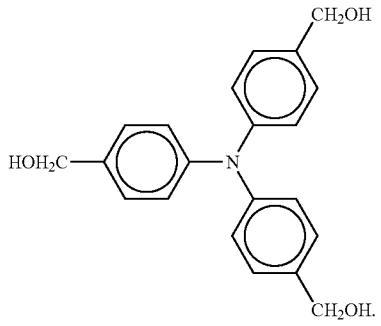

12. The image forming method according to claim 9, wherein the compound comprising a charge-transporting group and three or more methylol groups is a compound of general formula (1):

General Formula (1)

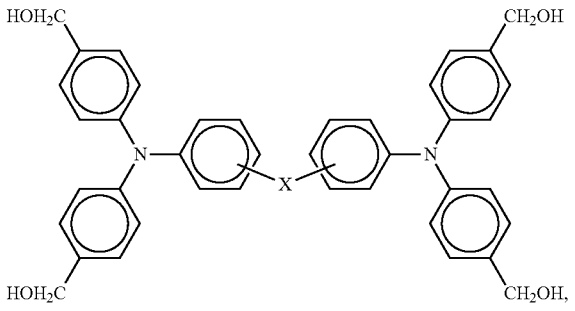

wherein X is —$CH_2$—, —O—, —CH═CH—, or —$CH_2CH_2$—.

13. The image forming method according to claim 9, wherein the different compound is a triphenyl amine of general formula (2):

General Formula (2)

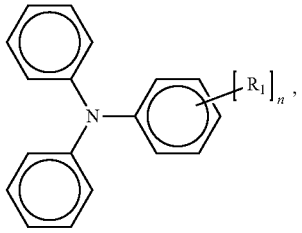

wherein $R_1$ is a hydrogen atom or a methyl group;

n is of from 1 to 4; and in the case where n is of from 2 to 4, $R_1$ may be identical or different.

14. The image forming method according to claim 9, wherein the different compound is a compound of general formula (3):

General Formula (3)

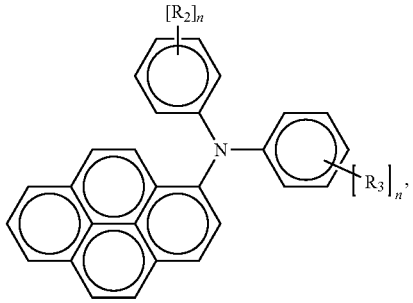

wherein $R_2$, and $R_3$ are each independently a hydrogen atom or a methyl group;

n is of from 1 to 4; and in the case where n is of from 2 to 4, $R_2$ may be identical or different and $R_3$ may be identical or different.

15. An image forming apparatus, comprising:

an electrophotographic photoconductor;

a charging unit configured to charge a surface of the electrophotographic photoconductor to obtain a charged surface;

an exposing unit configured to expose the charged surface of the electrophotographic photoconductor to light to form a latent electrostatic image;

a developing unit configured to develop the latent electrostatic image with a toner to form a visible image;

a transferring unit configured to transfer the visible image to a recording medium; and a fixing unit configured to fix the transferred visible image on the recording medium, wherein the electrophotographic photoconductor comprises:

a layer comprising a cured product obtained by crosslinking a compound comprising a charge-transporting group and three or more methylol groups, and a different compound comprising a charge-transporting group.

16. The image forming apparatus according to claim 15, wherein the exposing unit is configured to write the latent electrostatic image on the electrophotographic photoconductor with the light in a digital method.

17. The image forming apparatus according to claim 15, wherein the compound comprising a cured product obtained by crosslinking a compound comprising a charge-transporting group and three or more methylol groups is N,N,N-trimethyloltriphenyl amine of structural formula (1):

Structural Formula (1)

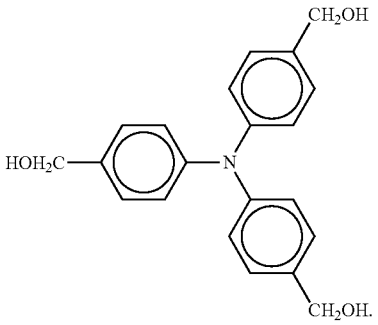

18. The image forming apparatus according to claim 15, wherein the compound comprising a charge-transporting group and three or more methylol groups is a compound of general formula (1):

General Formula (1)

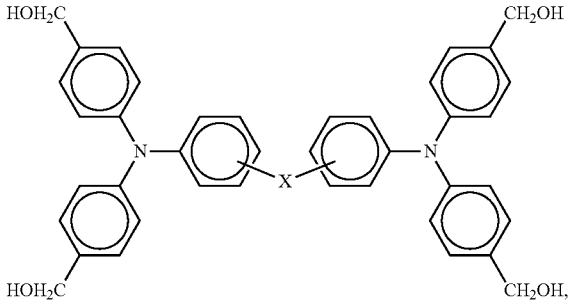

wherein X is —$CH_2$—, —O—, —CH═CH—, or —$CH_2CH_2$—.

19. The image forming apparatus according to claim 15, wherein the different compound is a triphenyl amine of general formula (2):

General Formula (2)

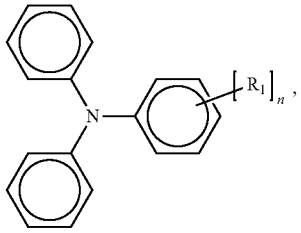

wherein $R_1$ is a hydrogen atom or a methyl group;

n is of from 1 to 4; and in the case where n is of from 2 to 4, $R_1$ may be identical or different.

20. The image forming apparatus according to claim 15, wherein the different compound is a compound of general formula (3):

General Formula (3)

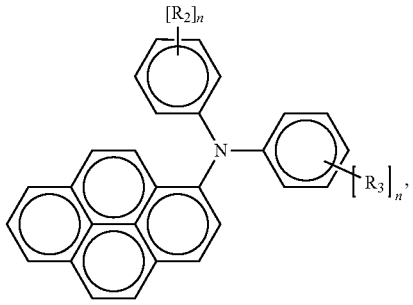

wherein $R_2$, and $R_3$ are each independently a hydrogen atom or a methyl group;

n is of from 1 to 4; and in the case where n is of from 2 to 4, $R_2$ may be identical or different and $R_3$ may be identical or different.

* * * * *